US007314993B2

(12) United States Patent
Nishitani et al.

(10) Patent No.: US 7,314,993 B2
(45) Date of Patent: Jan. 1, 2008

(54) AUTOMATIC PERFORMANCE APPARATUS AND AUTOMATIC PERFORMANCE PROGRAM

(75) Inventors: Yoshiki Nishitani, Shizuoka-ken (JP); Kenji Ishida, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 586 days.

(21) Appl. No.: 10/898,733

(22) Filed: Jul. 23, 2004

(65) Prior Publication Data

US 2005/0016362 A1 Jan. 27, 2005

(30) Foreign Application Priority Data

Jul. 23, 2003 (JP) ..... 2003-200747

(51) Int. Cl.
*G10H 7/00* (2006.01)

(52) U.S. Cl. ..... 84/612

(58) Field of Classification Search ..... 84/612, 84/600, 615

See application file for complete search history.

(56) References Cited

U.S. PATENT DOCUMENTS 5,338,891 A * 8/1994 Masubuchi et al. ..... 84/600
7,142,807 B2 * 11/2006 Lee ..... 455/3.01
2001/0015123 A1 8/2001 Nishitani et al.
2003/0066413 A1 4/2003 Nishitani et al.
2003/0121401 A1 * 7/2003 Ito ..... 84/625
2003/0167908 A1 9/2003 Nishitani et al.
2004/0069122 A1 * 4/2004 Wilson ..... 84/609

* cited by examiner

*Primary Examiner*—Jeffrey Donels
(74) *Attorney, Agent, or Firm*—Harness, Dickey & Pierce, PLC

(57) ABSTRACT

An automatic performance apparatus which enables expressive ensemble performance to be carried out with a sense of uniformity. Operation signals according to operation by at least one operator, and identification information for identifying a plurality of operating elements are output from these operating elements. Operation-related information indicative of the relationship between respective ones of the plurality of operating elements and respective ones of a plurality of channels, and the master-slave relationship between the plurality of operating elements are stored in a storage. When the operation signals and the identification information are output from the plurality of operating elements, the operation-related information is referred to determine corresponding ones of the channels to the identification information, a sounding event of a musical tone to be sounded next is read out from the performance data for each of the corresponding ones of the channels, and a sounding process on the readout sounding event is carried out by a sounding processing device. The sounding process is controlled such that the position of a sounding event corresponding to at least one of the operating elements as a slave never goes beyond the position of a sounding event corresponding to one of the operating elements as a master, which is to be processed next.

15 Claims, 14 Drawing Sheets

FIG. 4

| FIRST COLUMN | SECOND COLUMN | THIRD COLUMN | FOURTH COLUMN | FIFTH COLUMN | |
|---|---|---|---|---|---|
| DELTA TIME | MESSAGE | CHANNEL | NoteNum ProgNum CtrlNum | VALUE (DATA) | |
| 0 | Header | — | — | 480 (TIME UNIT) | FIRST ROW |
| 0 | MetaEvent | — | SetTempo | 500000 | SECOND ROW |
| 0 | SysEx | — | MasterVolume | 72 | THIRD ROW |
| 0 | SysEx | — | MasterBalance | 64 | FORTH ROW |
| 0 | SysEx | — | MasterReverb | 10 | FIFTH ROW |
| 0 | SysEx | — | MasterBrightness | 72 | SIXTH ROW |
| 0 | ProgChange | 1 | 5(ProgramNumber) | — | SEVENTH ROW |
| 0 | CtrlChange | 1 | 7(Volume) | 70 | EIGHTH ROW |
| 0 | CtrlChange | 1 | 10(Panpot) | 64 | NINTH ROW |
| 0 | CtrlChange | 1 | 91(ReverbSend) | 105 | TENTH ROW |
| 0 | CtrlChange | 1 | 74(Brightness) | 72 | ELEVENTH ROW |
| 0 | NoteOn | 1 | C4 | 64 | TWELFTH ROW |
| 0 | NoteOn | 2 | E4 | 64 | |
| 0 | NoteOn | 3 | G4 | 64 | |
| 0 | NoteOn | 4 | B4 | 64 | |
| 0 | NoteOn | 5 | C3 | 64 | |
| 240 | NoteOff | 2 | E4 | 64 | |
| 0 | NoteOff | 3 | G4 | 64 | |
| 0 | NoteOff | 4 | B4 | 64 | |
| 0 | NoteOff | 5 | C3 | 64 | |
| 0 | NoteOn | 2 | F4 | 64 | |
| 0 | NoteOn | 3 | A4 | 64 | |
| 0 | NoteOn | 4 | F4 | 64 | |
| 0 | NoteOn | 5 | F4 | 64 | |
| 240 | NoteOff | 1 | C4 | 64 | |
| ⋮ | ⋮ | ⋮ | ⋮ | ⋮ | |

| CHANNEL | OPERATING ELEMENT | IDENTIFICATION INFORMATION |
|---|---|---|
| — | 1-1 | SID(1-1) |
| — | 1-2 | SID(1-2) |
| — | 1-3 | SID(1-3) |
| — | 1-4 | SID(1-4) |
| — | 1-5 | SID(1-5) |

FIG. 8

| DELTA TIME | MESSAGE | CHANNEL | NoteNum ProgNum CtrlNum | VALUE (DATA) |
|---|---|---|---|---|
| 0 | Header | — | — | 480 (TIME UNIT) |
| 0 | MetaEvent | — | SetTempo | 500000 |
| 0 | SysEx | — | MasterVolume | 72 |
| 0 | SysEx | — | MasterBalance | 64 |
| 0 | SysEx | — | MasterReverb | 10 |
| | | | | |
| 0 | NoteOn | 1 | E3 | 64 |
| 480 | NoteOff | 1 | E3 | 64 |
| 0 | NoteOn | 1 | F3 | 64 |
| 240 | NoteOff | 1 | F3 | 64 |
| 0 | NoteOn | 1 | G3 | 64 |
| 240 | NoteOff | 1 | G3 | 64 |
| 0 | NoteOn | 1 | A3 | 64 |
| 0 | NoteOn | 1 | C4 | 64 |
| 480 | NoteOff | 1 | A3 | 64 |
| 0 | NoteOff | 1 | C4 | 64 |
| 0 | NoteOn | 1 | B3 | 64 |
| 0 | NoteOn | 1 | D4 | 64 |
| 480 | NoteOff | 1 | B3 | 64 |
| 0 | NoteOff | 1 | D4 | 64 |
| 0 | NoteOn | 1 | C4 | 64 |
| 960 | NoteOff | 1 | C4 | 64 |
| | | | | |

FIG. 10A

| | DELTA TIME | MESSAGE | CHANNEL | NoteNum ProgNum CtrlNum | VALUE (DATA) |
|---|---|---|---|---|---|
| $t_1$ | 0 | NoteOn | 1 | E3 | 64 |
| | 0 | NoteOn | 2 | C3 | 64 |
| $t_2$ | 480 | NoteOff | 1 | E3 | 64 |
| | 0 | NoteOff | 2 | C3 | 64 |
| | 0 | NoteOn | 1 | F3 | 64 |
| | 0 | NoteOn | 2 | E3 | 64 |
| | 0 | NoteOn | 2 | G3 | 64 |
| $t_3$ | 240 | NoteOff | 1 | F3 | 64 |
| | 0 | NoteOff | 2 | E3 | 64 |
| | 0 | NoteOff | 2 | G3 | 64 |
| | 0 | NoteOn | 1 | G3 | 64 |
| | 0 | NoteOn | 2 | E3 | 64 |
| | 0 | NoteOn | 2 | G3 | 64 |
| $t_4$ | 240 | NoteOff | 1 | G3 | 64 |
| | 0 | NoteOff | 2 | E3 | 64 |
| | 0 | NoteOff | 2 | G3 | 64 |
| | 0 | NoteOn | 1 | A3 | 64 |
| | 0 | NoteOn | 1 | C4 | 64 |
| | 0 | NoteOn | 2 | E3 | 64 |

FIG. 10B

| | | | | | |
|---|---|---|---|---|---|
| $t_5$ | 480 | NoteOff | 1 | A3 | 64 |
| | 0 | NoteOff | 1 | C4 | 64 |
| | 0 | NoteOff | 2 | E3 | 64 |
| | 0 | NoteOn | 1 | B3 | 64 |
| | 0 | NoteOn | 1 | D4 | 64 |
| | 0 | NoteOn | 2 | G3 | 64 |
| | 0 | NoteOn | 2 | B3 | 64 |
| | 240 | NoteOff | 2 | G3 | 64 |
| | 0 | NoteOff | 2 | B3 | 64 |
| | 0 | NoteOn | 2 | G3 | 64 |
| | 0 | NoteOn | 2 | B3 | 64 |
| $t_6$ | 240 | NoteOff | 1 | B3 | 64 |
| | 0 | NoteOff | 1 | D4 | 64 |
| | 0 | NoteOff | 2 | G3 | 64 |
| | 0 | NoteOff | 2 | B3 | 64 |
| | 0 | NoteOn | 1 | C4 | 64 |
| | 0 | NoteOn | 2 | G3 | 64 |
| | 240 | NoteOff | 2 | G3 | 64 |
| | 0 | NoteOn | 2 | A3 | 64 |
| | 240 | NoteOff | 2 | A3 | 64 |
| | 0 | NoteOn | 2 | B3 | 64 |
| | 240 | NoteOff | 2 | B3 | 64 |
| | 0 | NoteOn | 2 | C4 | 64 |
| | 240 | NoteOff | 1 | C4 | 64 |
| | 0 | NoteOff | 2 | C4 | 64 |

<MULTIPLE OPERATING ELEMENT PERFORMANCE MODE MANAGEMENT TABLE>

TA1

| CHANNEL | OPERATING ELEMENT | IDENTIFICATION INFORMATION | PERFORMANCE CONTROL MODE | PROPERTY INFORMATION |
|---|---|---|---|---|
| 1 | 1-1 | SID(1-1) | NOTE | MASTER |
| 2 | 1-2 | SID(1-2) | NOTE | SLAVE |

<VOLUME MANAGEMENT TABLE> TA2

| PEAK VALUE | VOLUME VALUE |
|---|---|
| $a_n \leqq p_{sp}$ | $v_n$ |
| $a_{n-1} \leqq p_{sp} < a_n$ | $v_{n-1}$ |
| ⋮ | ⋮ |
| $a_1 \leqq p_{sp} < a_2$ | $v_1$ |
| $a_0 \leqq p_{sp} < a_1$ | $v_0$ |

$(a_0 < a_1 < a_2 \cdots < a_n)$
$(v_0 < v_1 < v_2 \cdots < v_n)$

AUTOMATIC PERFORMANCE APPARATUS AND AUTOMATIC PERFORMANCE PROGRAM

BACKGROUND OF THE INVENTION

1. Field of the Invention

The present invention relates to an automatic performance apparatus and an automatic performance program which enable ensemble performance to be carried out with ease.

2. Description of the Related Art

In recent years, various types of performance apparatuses which enable even a beginning musical instrument player who has no experience of playing a musical instrument to enjoy ensemble performance in an easy way have been developed in the field of electronic musical instruments. For example, there has been proposed a performance apparatus which respectively assigns a plurality of musical instrument parts constituting a piece of music for automatic performance to be carried out based on automatic performance data to a plurality of operating elements, and detects the operative states of the respective operating elements (such as "swinging", "patting", and "tilting") so that volume, tone color, performance tempo, etc. of part tones corresponding to the respective musical instruments can be independently changed (refer to Japanese Laid-Open Patent Publication (Kokai) No. 2001-350474, for example).

An operator who operates each operating element can easily control the performance of a part assigned to the operating element by e.g. swinging the operating element, and therefore, even a beginning musical instrument player can feel fulfilled in playing ensemble performance.

In the above conventional performance apparatus, however, the performance of each part is independently controlled through operation by each operator, and hence, for example, if each operator changes the performance tempo (progress) of a part assigned to an operating element according to his/her feeling about the motif of a piece of music, there is a great difference in the progress of performance between a plurality of parts. As a result, the performance of a piece of music composed of a plurality of parts lacks uniformity, and therefore it is impossible to carry out expressive ensemble performance with a sense of uniformity.

SUMMARY OF THE INVENTION

It is therefore an object of the present invention to provide an automatic performance apparatus and an automatic performance program which enable expressive ensemble performance to be carried out with a sense of uniformity.

To attain the above object, in a first aspect of the present invention, there is provided an automatic performance apparatus that carries out ensemble performance by sequentially reading out a plurality of sounding events representative of sounding contents of musical tones for a plurality of channels from performance data in which the plurality of sounding events are associated with the plurality of channels, and processing the readout sounding events comprises a plurality of operating elements that output operation signals according to operation by at least one operator, and identification information for identifying the plurality of operating elements, a storage that stores operation-related information indicative of a relationship between respective ones of the plurality of operating elements and respective ones of the plurality of channels, and a master-slave relationship between the plurality of operating elements, a sounding processing device operable when the operation signals and the identification information are output from the respective ones of the plurality of operating elements, to refer to the operation-related information to determine corresponding ones of the channels to the identification information, and read out a sounding event of a musical tone to be sounded next from the performance data for each of the corresponding ones of the channels and carry out a sounding process on the readout sounding event, and a sounding process control device that controls the sounding process carried out by the sounding processing device such that a position of a sounding event corresponding to at least one of the operating elements as a slave never goes beyond a position of a sounding event corresponding to one of the operating elements as a master, which is to be processed next by the sounding processing device.

According to the first aspect of the present invention, the sounding process carried out by the sounding processing device is controlled such that the position of a sounding event corresponding to an operating element as a slave never goes beyond the position of a sounding event corresponding to an operating element as a master, which is to be processed next by the sounding processing device. As a result, a difference in the progress of performance between the master operating element and the slave operating element can be reduced to realize expressive ensemble performance with a sense of uniformity.

Preferably, the sounding process control device is operable when an operation signal is output from the operating element as a slave, to determine whether a position of a sounding event corresponding to the operating element as the slave at a time point the operation signal is output has reached a position immediately before a position of a sounding event corresponding to the operating element as the master to be processed next by the sounding processing device, and when a result of the determination is negative, to cause the sounding processing device to proceed the sounding process according to the operation signal within such a range that the position of the sounding event corresponding to the operating element as the slave never goes beyond the position of the sounding event corresponding to the operating element as the slave to be processed next by the sounding processing device.

To attain the above object, in a second aspect of the present invention, there is provided an automatic performance apparatus that carries out ensemble performance by sequentially reading out a plurality of sounding events representative of sounding contents of musical tones for a plurality of channels from performance data in which the plurality of sounding events are associated with the plurality of channels, and processing the readout sounding events comprises a plurality of operating elements that output operation signals according to operation by at least one operator, and identification information for identifying the plurality of operating elements, a storage that stores operation-related information indicative of a relationship between respective ones of the plurality of operating elements and respective ones of the plurality of channels, and a master-slave relationship between the plurality of operating elements, a sounding processing device operable when the operation signals and the identification information are output from the respective ones of the plurality of operating elements, to refer to the operation-related information to determine corresponding ones of the channels to the identification information, and read out a sounding event of a musical tone to be sounded next from the performance data for each of the corresponding ones of the channels and carry out a sounding process on the readout sounding event, and a sounding process control device operable when a position of a sounding event corresponding to at least one of the operating elements as a slave is delayed by a predetermined amount or more behind a position of a sounding event corresponding to one of the operating elements as a master to be processed next by the sounding processing device, to cause the position of the sounding event corresponding to the operating element as the salve to skip to the position of the sounding event corresponding to the operating element as the master.

According to the second aspect of the present invention, in the case where the position of a sounding event corresponding to at least one of operating elements as a slave is delayed by a predetermined amount or more behind a position of a sounding event corresponding to one of operating elements as a master to be processed next by the sounding processing device, the position of the sounding event corresponding to the slave operating element is caused to skip to the position of the sounding event corresponding to the master operating element. Thus, performance corresponding to the master operating element is prioritized; performance corresponding to the slave operating element follows performance corresponding to the master operating element. As a result, a difference in the progress of performance between the master operating element and the slave operating element can be reduced to realize expressive ensemble performance with a sense of uniformity.

To attain the above object, in a third aspect of the present invention, there is provided an automatic performance program executable by a computer for carrying out ensemble performance by sequentially reading out a plurality of sounding events representative of sounding contents of musical tones for a plurality of channels from performance data in which the plurality of sounding events are associated with the plurality of channels, and processing the readout sounding events comprises a storage module storing operation-related information indicative of a relationship between respective ones of a plurality of operating elements that output operation signals according to operation by at least one operator and identification information for identifying the plurality of operating elements and respective ones of the plurality of channels, and a master-slave relationship between the plurality of operating elements, a sounding processing module operable when the operation signals and the identification information are output from the respective ones of the plurality of operating elements, to refer to the operation-related information to determine corresponding ones of the channels to the identification information, and read out a sounding event of a musical tone to be sounded next from the performance data for each of the corresponding ones of the channels and carry out a sounding process on the readout sounding event, and a sounding process control module for controlling the sounding process carried out by the sounding processing module such that a position of a sounding event corresponding to at least one of the operating elements as a slave never goes beyond a position of a sounding event corresponding to one of the operating elements as a master to be processed next by the sounding processing module.

To attain the above object, in a fourth aspect of the present invention, there is provided an automatic performance program executable by a computer for carrying out ensemble performance by sequentially reading out a plurality of sounding events representative of sounding contents of musical tones for a plurality of channels from performance data in which the plurality of sounding events are associated with the plurality of channels, and processing the readout sounding events comprises a storage module storing operation-related information indicative of a relationship between respective ones of a plurality of operating elements that output operation signals according to operation by at least one operator and identification information for identifying the plurality of operating elements and respective ones of the plurality of channels, and a master-slave relationship between the plurality of operating elements, a sounding processing module operable when the operation signals and the identification information are output from the respective ones of the plurality of operating elements, to refer to the operation-related information to determine corresponding ones of the channels to the identification information, and read out a sounding event of a musical tone to be sounded next from the performance data for each of the corresponding ones of the channels and carry out a sounding process on the readout sounding event, and a sounding process control module for, when a position of a sounding event corresponding to at least one of the operating elements as a slave is delayed by a predetermined amount or more behind a position of a sounding event corresponding to one of the operating elements as a master to be processed next by the sounding processing module, causing the position of the sounding event corresponding to the operating element as the salve to skip to the position of the sounding event corresponding to the operating element as the master.

To attain the above object, in a fifth aspect of the present invention, there is provided an automatic performance apparatus that carries out automatic performance by sequentially reading out sounding events representative of contents of musical tones from performance data containing the sounding events comprises at least one operating element that outputs an operation signal according to operation by at least one operator, a sounding processing device operable when the operation signal is output, to read out a sounding event of a musical tone to be sounded next from the performance data, and carry out a sounding process on the readout sounding event, a time interval calculating device that detects an output time at which the operation signal is output, and calculates a time interval between the detected output time and a previously detected output time, a tempo updating device that updates a tempo according to the time interval calculated by the time interval calculating device and a length of a note of the sounding event on which the sounding process has been carried out in a time period between the detected output time and the previously detected output time, and a sounding length control device that controls a sounding length of a sounding event to be processed next by the sounding processing device to a length corresponding to the tempo updated by the tempo updating device.

According to the fifth aspect of the present invention, it is possible to carry out expressive ensemble performance with a sense of uniformity, and to smoothly update the tempo of performance according to the operative states of the operating elements.

Preferably, when there are a plurality of sounding events to be sounded at a same time, the sounding processing device reads out all of the plurality of events from the performance data, and carry out sounding processes on the readout events.

To attain the above object, in a sixth aspect of the present invention, there is provided an automatic performance apparatus that carries out ensemble performance by sequentially reading out a plurality of sounding events representative of sounding contents of musical tones for a plurality of channels in parallel from performance data in which the plurality of sounding events are associated with the plurality of channels, and processing the readout sounding events comprises at least one operating element that outputs an operation signal according to operation by at least one operator, a specific channel sounding processing device operable when the operation signal is output, to read out a sounding event of a musical tone to be sounded next from the performance data for a predetermined specific channel, and carry out a sounding process on the readout sounding event, a time interval calculating device that detects an output time at which the operation signal is output, and calculates a time interval between the detected output time and a previously detected output time, a tempo updating device that updates a tempo according to the time interval calculated by the time interval calculating device and a length of a note of the sounding event on which the sounding process has been carried out in a time period between the detected output time and the previously detected output time, a sounding length control device that controls a sounding length of a sounding event to be processed next by the sounding processing device to a length corresponding to the tempo updated by the tempo updating device, and an other channel sounding control device that sequentially reads out at least one sounding event for at least one other channel, which exists in an time interval from the sounding event being processed by the specific channel sounding processing device to a next sounding event, from the performance data at a velocity corresponding to the tempo updated by the tempo updating device, carries out a sounding process on the readout at least one sounding event according to sounding contents represented by the readout at least one sounding event, and controls a sounding length of the at least one sounding event for the at least one other channel to a length corresponding to the updated tempo.

According to the sixth aspect of the present invention, the same effects can be obtained as in the fifth aspect of the present invention.

Preferably, when there are a plurality of sounding events to be sounded at a same time, the sounding processing device reads out all of the plurality of events from the performance data, and carry out sounding processes on the readout events.

To attain the above object, in a seventh aspect of the present invention, there is provided an automatic performance program executable by a computer comprises a sounding processing module operable when a sounding instruction signal is output, to read out a sounding event of a musical tone to be sounded next from performance data, and carry out a sounding process on the readout sounding event according to sounding contents represented by the readout sounding event, a time interval calculating module for detecting a reception time at which the sounding instruction signal is received, and calculates a time interval between the detected reception time and a previously detected reception time, a tempo updating module for updating a tempo according to the time interval calculated by the time interval calculating module and a length of a note of the sounding event on which the sounding process has been carried out in a time period between the detected reception time and the previously detected reception time, and a sounding length control module for controlling a sounding length of a sounding event to be processed next by the sounding processing module to a length corresponding to the tempo updated by the tempo updating module.

To attain the above object, in an eighth aspect of the present invention, there is provided an automatic performance program executable by a computer comprises a specific channel sounding processing module operable when a sounding instruction signal is output, to read out a sounding event of a musical tone to be sounded next from performance data, and carry out a sounding process on the readout sounding event according to sounding contents represented by the readout sounding event, a time interval calculating module for detecting a reception time at which the sounding instruction signal is received, and calculates a time interval between the detected reception time and a previously detected reception time, a tempo updating module for updating a tempo according to the time interval calculated by the time interval calculating module and a length of a note of the sounding event on which the sounding process has been carried out in a time period between the detected reception time and the previously detected reception time, a sounding length control module for controlling a sounding length of a sounding event to be processed next by the sounding processing module to a length corresponding to the tempo updated by the tempo updating module, and an other channel sounding control module for sequentially reading out at least one sounding event for at least one other channel, which exists in an time interval from the sounding event being processed by the specific channel sounding processing module to a next sounding event, from the performance data at a velocity corresponding to the tempo updated by the tempo updating module, carrying out a sounding process on the readout at least one sounding event according to sounding contents represented by the readout at least one sounding event, and controlling a sounding length of the at least one sounding event for the at least one other channel to a length corresponding to the updated tempo.

The above and other objects, features, and advantages of the invention will become more apparent from the following detailed description taken in conjunction with the accompanying drawings.

BRIEF DESCRIPTION OF THE DRAWINGS

FIG. 4 is a view showing the structure of performance data used in the personal computer appearing in FIG. 1;

FIG. 8 is a view showing the structure of performance data corresponding to the score appearing in FIG. 7;

FIGS. 10A and 10B are view showing the structure of performance data corresponding to the score appearing in FIG. 9;

DETAILED DESCRIPTION OF THE PREFERRED EMBODIMENTS

Figure 1:
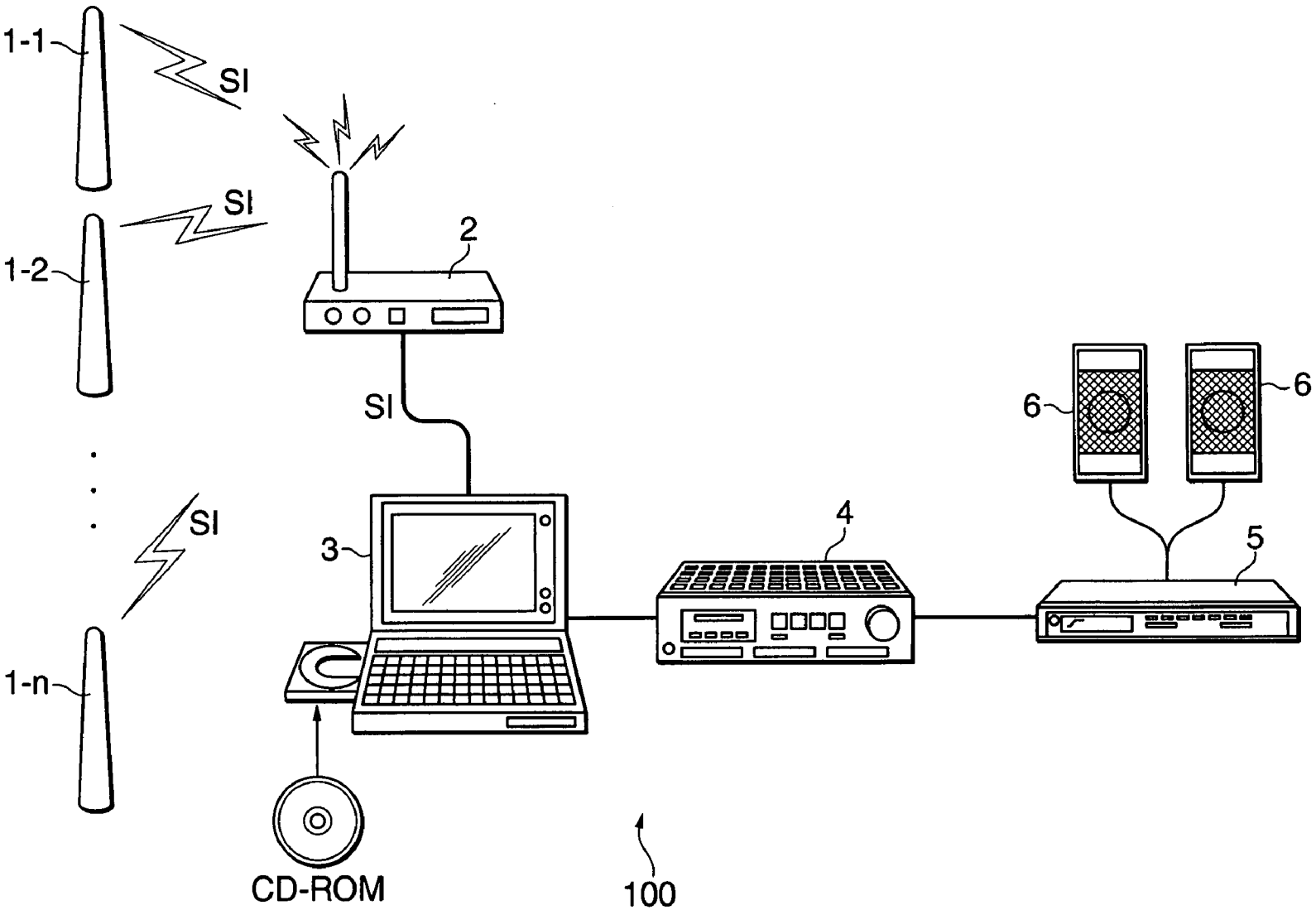
FIG. 1 is a view showing the arrangement of a system to which an automatic performance apparatus according to an embodiment of the present invention is applied.

The present invention will now be described in detail with reference to the drawings showing a preferred embodiment thereof. In the drawings, elements and parts which are identical throughout the views are designated by identical reference numeral, and duplicate description thereof is omitted.

Figure 3:
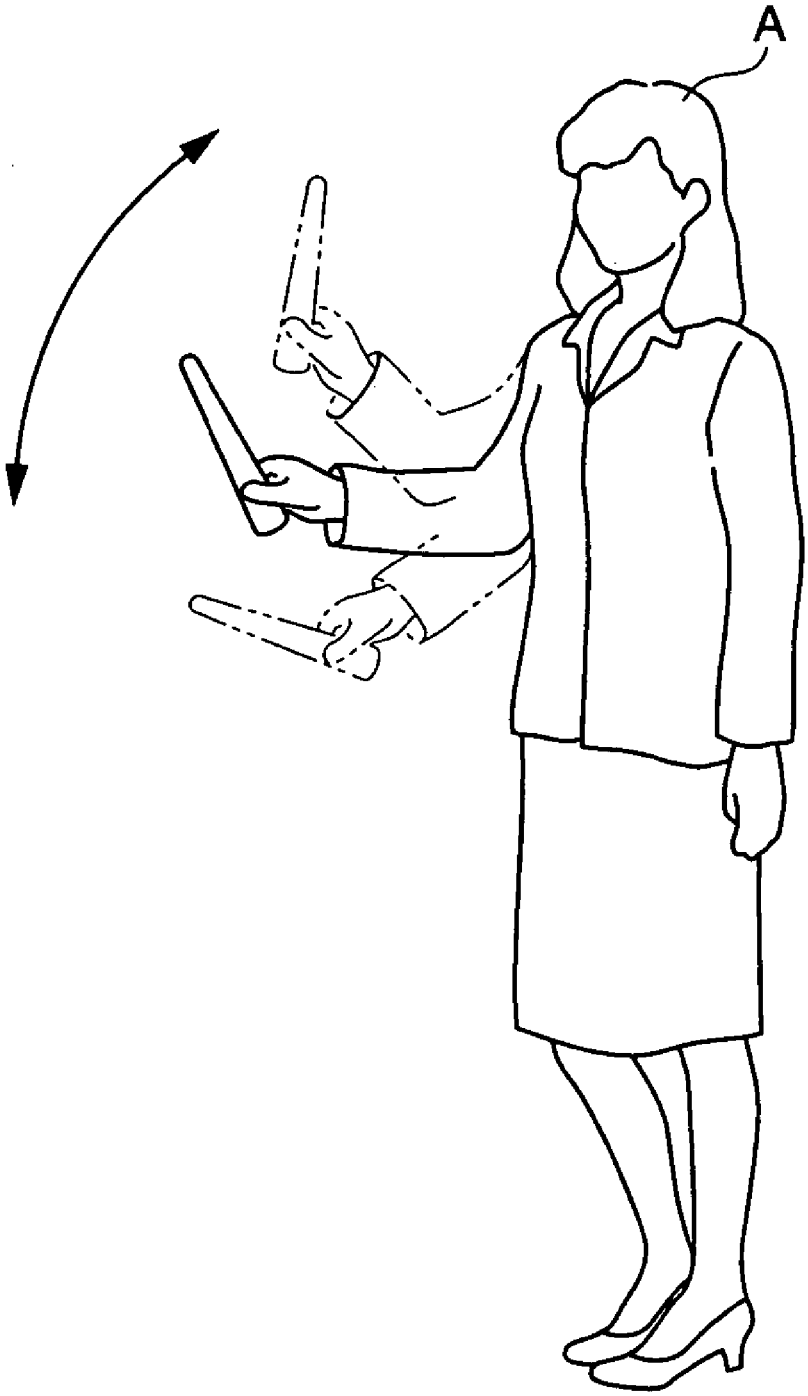
FIG. 3 is a view showing how an operating element appearing in FIG. 1 is operated.

FIG. 1 is a view showing the arrangement of a system to which an automatic performance apparatus according to an embodiment of the present invention is applied. As shown in FIG. 1, each of operating elements 1-1, 1-2, . . . , 1-n (n is an integer) is rod-shaped so as to be held and freely moved by an operator A as shown in FIG. 3. It should be noted that the operating elements 1-1 to 1-n are collectively referred to as "the operating element 1" as the need arises.

The operating element 1 has a sensor, which detects the motion of the operating element 1, incorporated therein. In the present embodiment, the sensor is implemented by a velocity sensor which detects that the operating element 1 is being swung. The operating element 1 outputs a peak signal SP corresponding to a change in an output signal from the velocity sensor when the operating element is swung down (i.e. an operation signal corresponding to an operation of the operating element 1). It should be noted that in the present embodiment, other sensors (such as an acceleration sensor) may be used insofar as they can detect that the operating element 1 is being swung down. The operating element 1 also outputs an identification signal SID for identifying itself. It should be noted that respective pieces of identification information on the operating elements 1-1 to 1-n are represented by SID (1-1) to SID (1-n).

The operating element 1 sends sensor information SI including the peak signal SP and the identification information SID to a receiving device 2 by wireless, and the receiving device 2 supplies the sensor signal SI to a personal computer 3. It should be noted that in the present embodiment, a Bluetooth (registered trademark) wireless transfer method is used, but other wireless transfer methods may be arbitrarily used.

Figure 2:
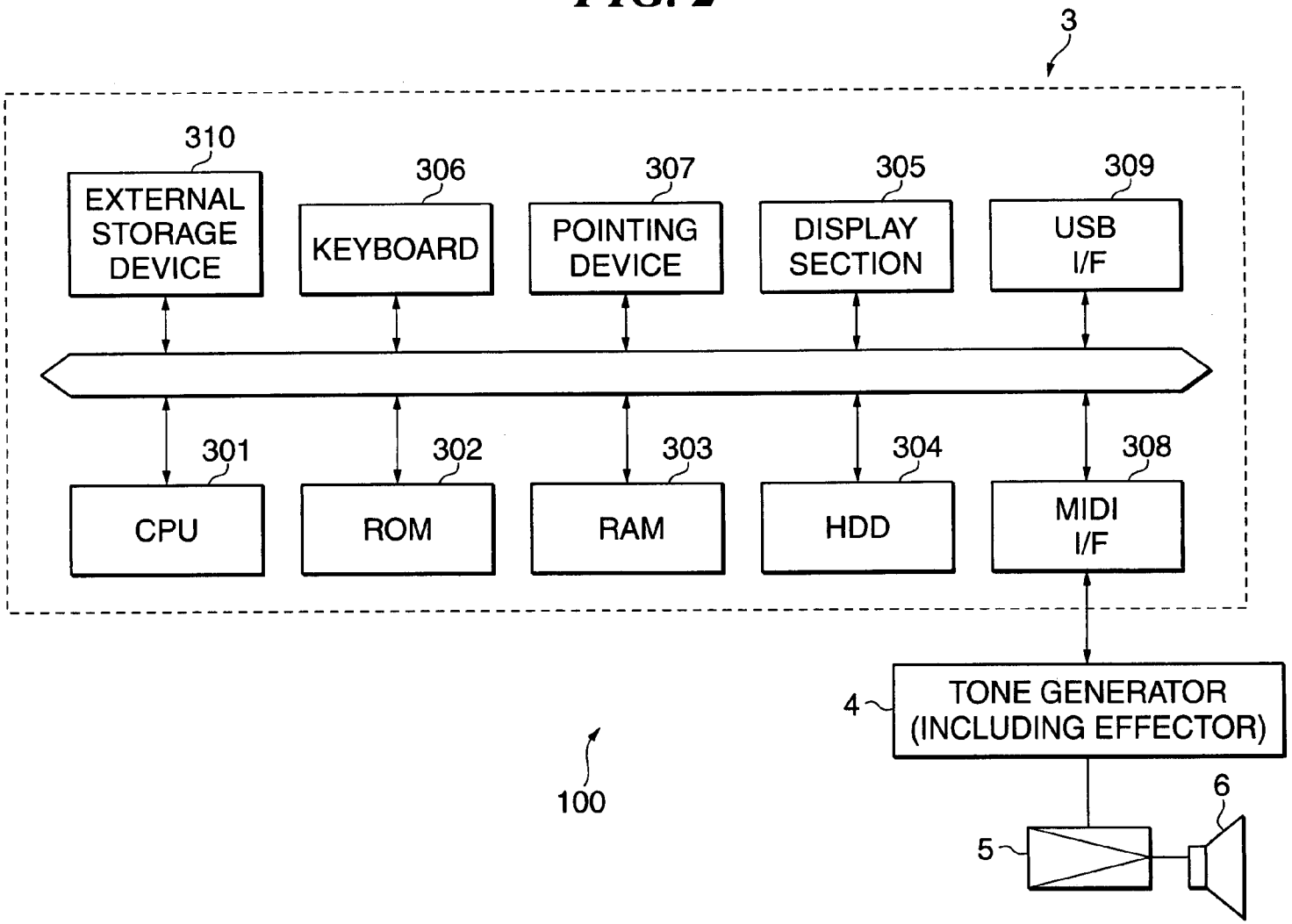
FIG. 2 is a block diagram showing the construction of a personal computer appearing in FIG. 1.

FIG. 2 is a block diagram showing the construction of the personal computer 3 appearing in FIG. 1. The receiving device 2 is connected to a USB (Universal Serial Bus) interface (I/F) 309. The sensor information SI is supplied to a CPU 301 via the USB interface 309.

As shown in FIG. 2, the CPU 301 controls the overall operation of the personal computer 3 by using a storage area of a RAM 303 as a working area, and executing various programs stored in a ROM 302. A plurality of pieces of performance data are stored in a hard disk device (hereinafter referred to as "the HDD") 304, and a plurality of pieces of performance data are also recorded in a CD-ROM inserted into an external storage device 310. In the present embodiment, performance data to be used conforms to the MIDI standards, and is comprised of a collection of musical tone parameters that specify musical tones.

When an operator gives an instruction to carry out automatic performance, performance data designated by the instruction is called from the HDD 304 or the CD-ROM and stored in a performance data storage area of the RAM 303. A plurality of musical tone parameters constituting the performance data stored in the performance data storage area are sequentially read out by the CPU 301 as performance proceeds.

A display section 305 displays various kinds of information under the control of the CPU 301. A keyboard 306 and a pointing device 307 input various instructions and various kinds of information according to the operation of an operator. A MIDI interface 308 provides interface for transmission and reception of musical tone parameters conforming to the MIDI standards between the personal computer 3 and a tone generator 4.

The tone generator 4 appearing in FIG. 1 receives musical tone parameters conforming to the MIDI standards output from the personal computer 3, and generates a musical tone signal based on the received musical tone parameters. The musical tone signal is generated according to the pitch, volume, reverberation, brightness, or sound image represented by the musical tone parameters. The musical tone signal is supplied to and amplified by an amplifier 5, and then sounded via speakers 6.

The above receiving device 2, personal computer 3, tone generator 4, amplifier 5, and speakers 6 constitute an automatic performance apparatus 100.

A description will now be given of the performance data stored in the HDD 304 or the CD-ROM.

In the present embodiment, automatic performance is carried out using performance data conforming to the MIDI standards as described above. Examples of musical tone parameters constituting the performance data include those which represent the pitch, tone length, velocity (intensity), and so forth of every musical note, those which affect a piece of music as a whole (such as total volume, tempo, reverberation, and localization of sound), and those which affect a specific part as a whole (such as reverberation or localization of sound for each part).

In the present embodiment, the musical tone parameters are sequentially read out as performance proceeds, and the progress of a piece of music is controlled according to the operation of the operating element 1.

Referring to FIG. 4, a detailed description will now be given of the performance data used in the present embodiment. FIG. 4 is a view showing the structure of the performance data, which is a matrix of rows and columns. First, a description will be given of the columns.

The delta time in the first column represents the time interval between events, and is expressed as the number of tempo clocks. If the delta time is "0", an event and an immediately preceding event are executed at the same time (or in parallel).

In the second column, the contents of a message owned by each event are described. Examples of the message include a note-on message (NoteOn) indicative of a sounding event, a note-off message (NoteOff) indicative of a muting event, and a control change message (CtrlChange) designating volume or pan-pot (localization of sound).

In the third column, a channel number is written. Channels corresponded to respective different performance parts; ensemble performance is carried out by performance in a plurality of channels at the same time or in parallel. It should be noted that such event data as meta event data and exclusive event data which are independent of channels have no values in the third column.

In the fourth column, a note number (NoteNum), a program number (ProgNum), or a control number (CtrlNum) is written, and which number is to be written depends on the contents of the message. For example, if the message is comprised of a note-on message or a note-off message, a note number indicative of a scale is written, and if the message is comprised of a control change message, a control number indicative of the type of the control change message (volume or pan-pot) is written.

In the fifth column, a specific value (data) of a MIDI message is written. For example, if the message is comprised of a note-on message or a note-off message, a value indicative of a velocity which represents the intensity of a tone is written, and if the message is comprised of a control change message, a parameter value corresponding to a control number is written.

Next, a description will be given of the rows in FIG. 4. First, a header (Header) in the first row indicates a time unit. The "time unit" indicates a resolution, and is expressed as the number of tempo clocks per quarter note. In FIG. 4, a value of "480" is set, which means that an instruction for making one quarter note correspond to 480 tempo clocks has been given.

A tempo set value (SetTempo) in the second row designates the velocity of performance, and expresses the length of a quarter note in microseconds. For example, if the tempo is set such that the quarter note=120, this means that there are 120 beats of quarter notes within one minute, a value of 60 (seconds)/120(beats)×1000000=500000 (microseconds) is set as a tempo set value. Automatic performance is carried out at a velocity based on tempo clocks, and the period of the tempo clocks is controlled according to the tempo set value and the time unit. Therefore, if the tempo set value (SetTempo) is "500000" and the time unit is "480", the period of the tempo clocks is 1/960.

In the third to sixth rows, system exclusive messages are described, and in the seventh to eleventh rows, program change messages and control change messages are described. These messages are indicative of musical tone parameters which affect a piece of music as a whole, but they are not related to the gist of the present invention, and therefore description thereof is omitted.

In the twelfth and subsequent rows, musical tone parameters relating to musical notes for the respective channels are written. The musical tone parameters are comprised of a note-on event (NoteOn) indicative of a sounding event, and a note-off event (NoteOff) indicative of a muting event, and a note number (NoteNum) indicative of the pitch and a velocity (Velocity) indicative of the intensity of a tone are added to each event.

A description will now be given of how performance is carried out based on a sequence of musical notes in FIG. 4. First, tones "C4", "E4", "G4", "B4", and "C3" are sounded at the same time in channels "1", "2", "3", "4", and "5", respectively. Then, upon the lapse of a delta time "240", the channels "2" to "5" are muted at the same time. On this occasion, no note-off event is written for the channel "1", and hence the tone "C4" is continuously sounded in the channel "1". In the channels "2" to "5", when the tones are muted, the next tones are sounded at the same time. Specifically, a tone "F4" is sounded in the channels "2", "4", and "5", and a tone "A4" is sounded in the channel "3".

In the above described sequence, sounding and muting are repeated in each channel so that performance can proceed.

Specifically, in an ordinary automatic performance process using MIDI data, the execution of an event upon the lapse of a delta time is sequentially repeated until the completion of performance. In the present embodiment, however, the progress of the performance of a piece of music according to the operation of the operating element 1 is controlled with a higher priority than the progress of the performance of a piece of music according to the delta time. This will be described later in further detail.

A description will now be given of tables which are set in the RAM 303. The CPU 301 carries out initialization according to a program in the ROM 302, which is activated when power supply of the personal computer 3 is turned on, and on this occasion, creates tables in FIGS. 5 and 6 in respective storage areas of the RAM 303.

Figures 5, 6:
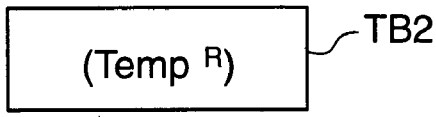
FIG. 5 is a view showing a channel setting table.
FIG. 6 is a view showing a current tempo table.

A table TB1 in FIG. 5 is a channel setting table, in which the relationship between operating elements and channels is set. It should be noted that the relationship between operating elements and channels can be freely changed by operating the keyboard 306 and/or the pointing device 307.

A Table TB2 in FIG. 6 is a current tempo table, which stores a tempo value Tempo-R according to the operation of the operating element 1 (the interval between swinging-down motions). The tempo value Tempo-R is updated each time the operating element is swung down. It should be noted that a tempo set value (SetTempo) included in performance data is written into the table TB2 upon initialization.

A description will now be given of processes carried out by the automatic performance apparatus 100.

The automatic performance apparatus 100 has various performance modes; if an operator carries out mode selection using the keyboard 306 or the like, a mode or a combination of modes is selected and set. A brief description will now be given of each mode. There are a single operating element performance mode in which one operator operates a single operating element, and a multiple operating element performance mode in which a plurality of operators operate respective operating elements to perform different parts. Also, each of the single operating element performance mode and the multiple operating element performance mode includes a manual mode in which the tempo is controlled according to the interval between swinging motions of the operating element 1 (i.e. so-called beat timing of a piece of music), and a note mode in which each time the operating element 1 is swung down, a note-on event for a corresponding channel is read out to be sounded. The contents of each mode will be described below.

a: Single Operating Element Performance Mode

In the single operating element performance mode, one operator operates a single operating element to control the performance of a part or a plurality of parts. In the single operating element performance mode, it is possible to select the note mode or the manual mode. The note mode in the case where the performance of a plurality of parts is controlled in the single operating element performance mode includes a note automatic mode and a note accompaniment mode.

(1) Note Mode

In the note mode, each time the operating element 1 is swung down, a note-on event (NoteOn) for a channel corresponding to e.g. a melody part is read out for sounding, and a note-on event for a channel corresponding to e.g. an accompaniment part is read out in timing in which the operating element 1 is swung down, for sounding, so that ensemble performance is automatically carried out.

(Performance of Single Performance Part)

Figure 7:
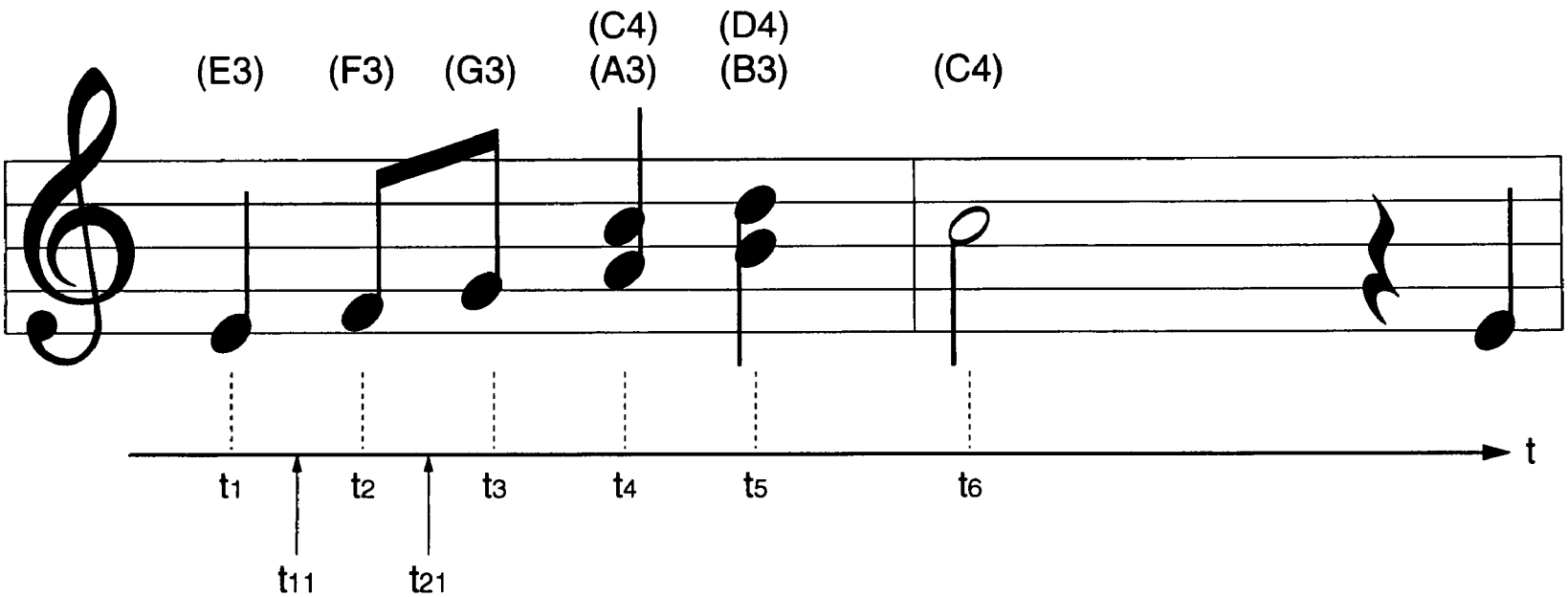
FIG. 7 is a view showing an example of a score of a piece of music composed of a single part.

First, a description will be given of the case where a single part is performed. FIG. 7 is a view showing an example of a score of a single part, and FIG. 8 is a view showing the structure of performance data corresponding to the score in FIG. 7. In the performance data in FIG. 8, the "time unit" is set to "480" (refer to FIG. 4), i.e. the delta time corresponding to the number of tempo clocks per quarter note is set to "480".

In response to an instruction for starting performance, the CPU 301 in FIG. 2 stores the performance data in FIG. 8 in the performance data storage area of the RAM 303, and sequentially reads out and processes the performance data starting with the first data. As to note-on events, a note-on event (NoteOn) for a tone E3 is first read out and transferred to the tone generator 4 via the MIDI interface 308. The tone generator 4 generates a musical tone signal for the tone E3, and the generated musical tone signal is amplified by the amplifier 5, and sounded via the speakers 6.

Then, upon the lapse of the delta time "480", i.e. after counting of 480 tempo clocks, a note-off event (NoteOff) for the tone E3 is read out to cause the tone E3 to be muted. As a result, the tone E3 is sounded only for the length of a quarter note. Also, simultaneously with the readout of the note-off event (NoteOff) for the tone E3, a note-on event (NoteOn) for a tone F3 as an event with a delta time "0" is read out for sounding. Then, upon the lapse of a delta time "240", a note-off event (NoteOff) for the tone F3 is read out, to cause the tone F3 to be muted. As a result, the tone F3 is sounded only for the length of an eighth note. Thereafter, sounding and muting are repeatedly carried out in the above described way, so that a piece of music in FIG. 7 is automatically performed. It should be noted that when a tone A3 is sounded, a tone C4 with a delta time "0" is sounded at the same time, and similarly, tones B3 and D4 are sounded at the same time. In this way, chords are automatically performed, too. The tempo of automatic performance is determined according to the period of tempo clocks, which is determined according to the tempo set value (SetTempo) as described above (refer to FIG. 4).

It is assumed that the tones are sounded by the above described automatic performance at times t1 to t6 as shown in FIG. 7. At the time t1 to t6, the tones are sounded in the case where performance is carried out at a fixed tempo based on the tempo set value (SetTempo).

A description will now be given of performance using the operating element 1 according to the present embodiment. First, an operator swings down the operating element 1 so as to instruct the automatic performance apparatus 100 to start performance (this swinging operation will hereinafter be referred to as "the forehand operation"). Upon the forehand operation by the operator, the operating element 1 outputs a peak signal SP indicative of a change in velocity when the operating element 1 is swung down. The peak signal SP is supplied to the CPU 301 via the receiving device 2. Upon reception of the first peak signal SP, the CPU 301 determines that the operator has performed the forehand operation, and sets the current tempo value Tempo-R in the current tempo table TB2 in FIG. 6 to the tempo set value (SetTempo). Then, the CPU 301 determines the period of tempo clocks according to the current tempo value Tempo-R. It should be noted that at the moment the forehand operation has been performed, automatic performance is not started, but the tempo clock is determined according to the tempo set value (SetTempo) in performance data.

Then, when the operator swings down the operating element 1, a peak signal (operation signal) SP is output in timing in which the operating element 1 is swung down. The peak signal SP is supplied to the CPU 301 via the receiving device 2. Upon reception of the peak signal SP, the CPU 301 reads out a note-on event (NoteOn) for a tone E3 in FIG. 8, and carries out sounding processing on the note-on event in the same manner as described above. Thus, in the present embodiment, automatic performance is not started until the operating element 1 is swung down after the forehand operation.

Then, the tone E3 is continuously sounded as long as the delta time "480" is counted, but when the operator swings down the operating element 1 again in timing earlier than the time t2, a note-off event (NoteOff) for the tone E3 and a note-on event (NoteOn) for a tone F3 are read out in the timing in which a peak signal SP is output in response to the swinging motion of the operator, whereby muting processing and sounding processing are performed. Namely, upon the second swinging (other than the swinging as the forehand operation; the same will apply hereinafter) at a time t11, for example, the tone E3 is muted, and the tone F3 is sounded.

On the other hand, in the case where there is no second swinging of the operating element even at the time t2, the CPU 301 reads out the note-off event (NoteOff) for the tone E3 to mute the tone E3 when the delta time "480" has been counted up. Then, the CPU 301 stores the address of a storage area of the RAM 303 on which this event is stored in a pointer, not shown, to temporarily stop the automatic performance without reading out the note-on event (Noteon) for the tone F3. That is, the CPU 301 does not start performing sounding processing on the next tone, but temporarily stops the automatic performance in the case where the next peak signal SP is not generated even when a note-off event (NoteOff) for a currently sounded tone is read out. Also, in the case where the delta time of a note-on event for the tone F3 to be sounded next is not "0" in relation to the note-off event for the tone E3 (the tones F3 and E3 are arranged in the score with a fermata interposed therebetween), the address of a storage area in which the note-on event (NoteOn) for the tone F3 to be sounded next is stored in the pointer to temporarily stop the automatic performance.

It should be noted that there may be a case where a plurality of tones, which are to be muted at different times, are sounded at the same time, but in this case, if a peak signal SP is not detected before a note-off event (NoteOff) for a tone to be muted last is read out, automatic performance is temporarily stopped without reading out the next note-on event (NoteOn).

When the operator swings down the operating element 1 after the automatic performance is stopped, a peak signal SP is output. Upon detection of the peak signal SP, the CPU 301 reads out the address of a storage area where a note-on event (NoteOn) for a tone to be sounded next is stored, and executes the note-on event (NoteOn) stored at the address. In the examples shown in FIGS. 7 and 8, if a peak signal SP is detected at a time T21, a note-on event (NoteOn) for a tone F3 is read out, and the tone F3 is sounded.

Further, in the above described processing, upon detection of a peak signal SP, the CPU 301 obtains the difference between the time the peak signal SP is detected and the time an immediately preceding peak signal SP is detected. Specifically, in FIG. 7, if a peak signal SP is detected at the time t11, a difference in time (t11-t1) is obtained since a peak signal SP was detected upon the forehand operation (time t1), or if a peak signal SP is not detected at the time t11, and a peak signal is detected at the time t21, a difference in time (t21-t1) is obtained. Then, the CPU 301 updates the tempo according to the obtained difference in time, and stores the updated tempo as the tempo value Tempo-R in the current tempo table TB2.

The updated tempo is determined according to the output time interval of peak signals SP and the length of a tone of a note sounded on that occasion. In the examples shown in FIGS. 7 and 8, the tone E3 is a quarter note, and the delta time is "480", and hence the tempo is obtained according to the output time interval of peak signals SP relative to the delta time.

For example, if a peak signal SP is output at the time t11, counting of the delta time "480" has not been completed, and hence the CPU 301 searches for a note-off event (NoteOff) for the tone E3, and determines a new tempo according to a delta time from the note-on event (NoteOn) to the note-off event (NoteOff) for the tone E3, and the difference in time (t11-t1).

In the above example, since the "time unit" is "480" and the tempo set value SetTempo (default value) is "500000", the sounding time period of the tone E3 as a quarter note is "500000" microseconds, and the tempo clock period is "1/960". If the difference in time (t11-t1) between peak signals SP is "400000" microseconds, the tempo value Tempo-R is updated to "400000". Then, the tempo clock period is changed according to the updated tempo value Tempo-R. As a result, the tempo becomes faster, and therefore, the sounding time period of the tone F3 to be sounded next is shorter than at the original tempo. On the other hand, if the difference in time (t21-t1) between peak signals SP is "600000" microseconds, the tempo value Tempo-R is updated to "600000". Then, the tempo clock period is changed according to the updated tempo value Tempo-R. As a result, the tempo becomes slower, so that the sounding time period of the tone F3 to be sounded next is longer than at the original tempo. Namely, the CPU 301 provides control such that the sounding time period of the tone F3 to be sounded next has a time length corresponding to the updated tempo.

It should be noted that if the tone E3 is an eighth note, the difference in time (t11-t1) or (t21-t1) represents the length of an eighth note at a new tempo, and is hence converted into a difference in time for a quarter note to thereby update the tempo value Tempo-R.

By the above described processing, the performance tempo can be smoothly updated according to the operative states of operating elements.

Although in the above described processing, the tempo Tempo-R is updated using a difference in time as it is, but to prevent the tempo from considerably changing, the tempo may be changed using a variation in difference in time, or an upper limit may be provided for a change in the tempo so that a change in the tempo is not greater than the upper limit.

Further, in the case where there are a plurality of delta times ahead of a note-off event (NoteOff) for the tone E3, a new tempo is obtained according to the sum of the delta times and the difference in time between peak signals.

Further, in the above described processing, automatic performance is temporarily stopped in the case where no peak signal SP is detected before a note-off event (NoteOff) for a tone being sounded, but if the automatic performance remains suspended for a predetermined period of time or longer, the tempo may not be updated, but the tempo clock period may be determined according to an immediately preceding tempo value Tempo-R stored in the current tempo table TB. This is because, if the performance of a piece of music is suspended for a long period of time, setting the tempo according to the suspension time period causes the tempo to be unnaturally slow, which is unsuitable for the performance of the piece of music. It should be noted that in this case, the tempo set value SetTempo as an initial tempo may be used.

(Simultaneous Performance of Multiple Performance Parts)

(1-1) Note Automatic Mode

Figure 9:
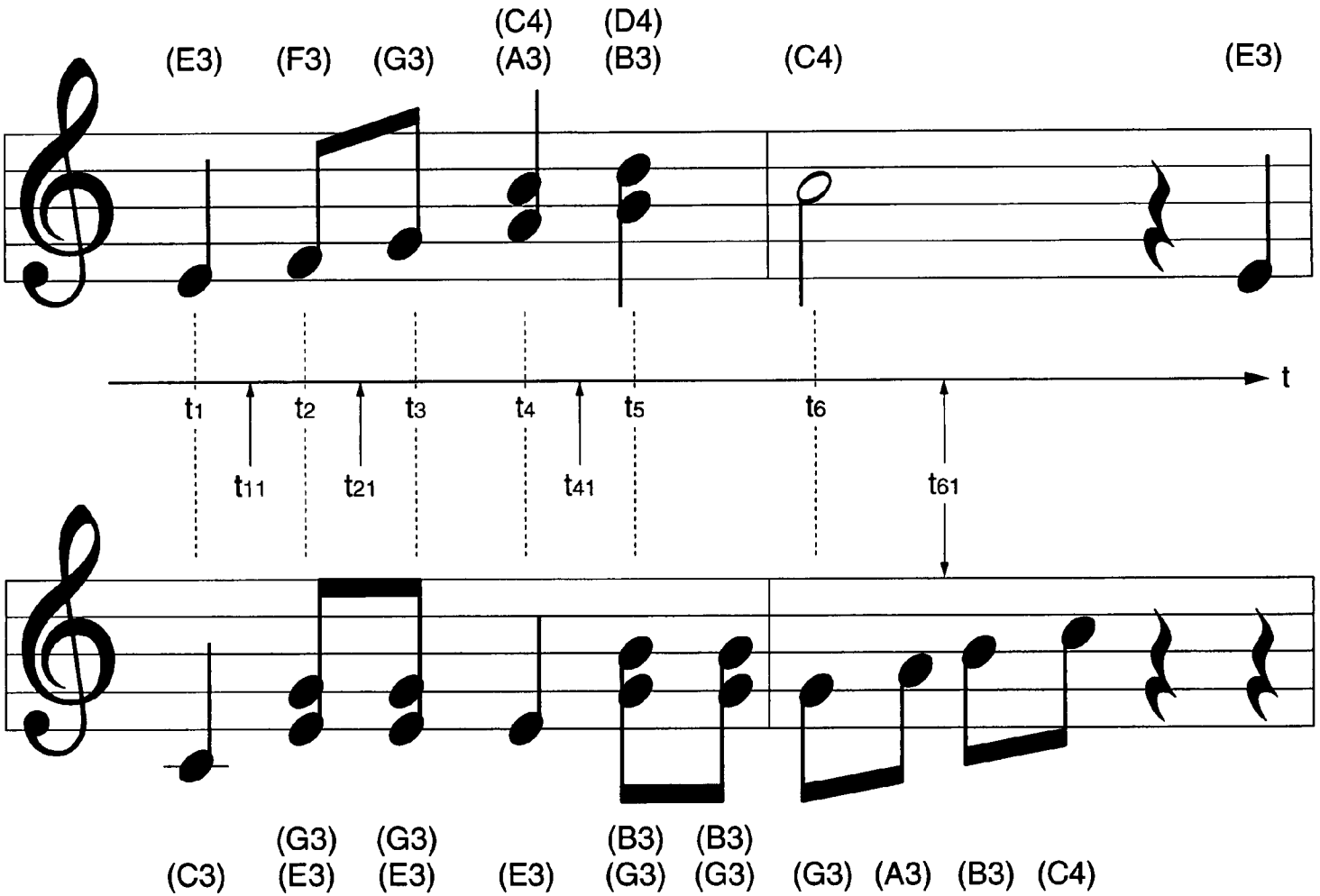
FIG. 9 is a view showing an example of a score of a piece of music composed of two parts.

A description will now be given of the case where one operator operates a single operating element to perform a plurality of parts. For the convenience of explanation, it is assumed here that a piece of music composed of two parts is performed. FIG. 9 is a view showing the score of a piece of music composed of two parts. In FIG. 9, a melody part is shown on the upper side, and an accompaniment part is shown on the lower side, which are assigned to a channel 1 (specific channel) and a channel 2 (another channel), respectively. It should be noted that the score of the melody part on the upper side is identical with the score in FIG. 7. FIGS. 10A and 10B are view showing the structure of performance data corresponding to the score in FIG. 9.

First, the relationship between operation and performance of the operating element 1 for the melody part is the same as in the case where a single part is performed as described above. For the accompaniment part, a note-on event (NoteOn) for a tone corresponding to a tone being sounded in the melody part is read out for sounding while the tones are synchronized. In other words, in simultaneous performance of a plurality of performance parts, in the case where there are a plurality of events which should be sounded at the same time (including not only the case where there are events to be sounded at the same time only in the melody part, but also the case where there are events to be sounded at the same time in the melody part and the accompaniment part), and in this case, all of the events which should be sounded at the same time are read out to be sounded.

This will now be concretely explained with reference to an example. If a note-on event (NoteOn) for a tone E3 in the melody part (channel 1) is read out at a time t1, a note-on event (NoteOn) for a tone C3 in the accompaniment part (channel 2) is read out, and processing is performed to sound both the tones E3 and C3. Then, if peak signals SP are output from the operating element 1 at times t2 to t6, note-on events (NoteOn) for tones in the accompaniment part corresponding to tones in the melody part are read out for sounding. In this case, at the times t5 and t6, a plurality of notes in the accompaniment part correspond to notes in the melody part, and processing is performed as described below.

At the time t5, note-on events (NoteOn) for tones B3 and D4 (quarter note) in the melody part and note-on events (NoteOn) for tones G3 and B3 (eighth note) in the accompaniment part are read out, and processing is performed to sound these tones. Then, the CPU 301 continuously counts a delta time "240" on condition that no peak signal SP has not been detected, and upon completion of counting, reads out note-off events (NoteOff) for the tones G3 and B3 in the accompaniment part (channel 2) from performance data to mute the tones G3 and B3, and immediately reads out note-on events (NoteOn) for tones G3 and B3 with a delta time "0" to sound the tones G3 and B3. Then, the CPU 301 counts a delta time "240". The tempo clock period during the counting is determined according to the tempo value Tempo-R in the current tempo table TB2 (refer to FIG. 6).

Namely, the tempo clock period is determined according to an output time interval between a peak signal SP and an immediately preceding peak signal SP.

When the counting of the delta time "240" is completed, note-off events (NoteOff) for the tones B3 and D4 in the melody part and the tones G3 and B3 in the accompaniment part are read out, and processing is performed to mute these tones. In other words, on condition that no peak signal has been detected, the CPU 301 sequentially reads out e.g. note-on events (NoteOn) in the accompaniment part, which exist during a period of time from the note-on events (NoteOn) for the tones B3 and D4 (quarter note), which have been processed at the time t5, to the next note-on event (NoteOn) for a tone C4 (half note) in the melody part at a velocity corresponding to the updated tempo, and controls the sounding lengths of these note-on events in the accompaniment part according to the updated tempo. By this processing, tones of two eighth notes in the accompaniment part are sounded in synchronism with sounding of tones of one quarter note in the melody part. At the time t6, the tones G3, A3, B3, and C (eighth note) in the accompaniment part correspond to the tone C4 (quarter note) in the melody part, and these tones are processed in the same manner as described above.

Next, a description will be given of how accompaniment tones are processed to be sounded when the operator changes the tempo. Here, it is assumed that the operator swings down the operating element 1 at the time t4 and then swings down the operating element 1 again at a time t41 before the time t5. As a result, a peak signal SP is detected at the time T41, and therefore, the CPU 301 immediately performs processing to mute the tones being sounded (A3 and C4) in the melody part, and at the same time, performs processing to mute the tone E3 in the accompaniment part. Then, the CPU 301 reads out note-on events (NoteOn) for the tones B3 and D4 in the melody part to be sounded next, and reads out note-on events (NoteOn) for the tones G3 and B3 with a delta time "0" in the accompaniment part to perform processing to sound these tones.

Conversely, in the case where the operator does not swing down the operating element 1 at the time 4, but swings down the operating element 1 at the time t41 immediately after the time t4, the tone G3 in the melody part, which has been sounded at the time t4, is sounded for a time length corresponding to the current tempo, and processed to be muted, and the corresponding tones E3 and G3 in the accompaniment part are muted together with the G3 in the melody part. Thereafter, the detection of a peak signal SP is awaited, and at the time t41 a peak signal SP is detected, the tones B3 and D4 in the melody part and the tones G3 and B3 in the accompaniment part are sounded.

As stated above, sounding processing and muting processing are performed on melody tones according to operation by the operator, and in synchronism with these processing, sounding processing and muting processing are performed on accompaniment tones.

The tone C4 in the melody part is sounded at the time t6, and accordingly the tone G3 in the accompaniment part is subjected to sounding processing and muting processing, and then the tone A3 is subjected to sounding processing and then to muting processing. Then, if a peak signal SP is detected at a time T61, the CPU 301 reads out a note-on event for a tone E3 to be sounded next and performs sounding processing on the tone E3, while skipping processing on the tones B3 and C4 (eighth note), so that the tones B3 and C4 are not sounded.

In this way, the melody part is performed with a higher priority than the accompaniment part, and sounding processing and muting processing on the accompaniment part is controlled so as to follow the melody part.

(1-2) Note Accompaniment Mode

Next, a description will be given of the note accompaniment mode. In this mode, so-called normal automatic performance processing is carried out at a tempo designated by performance data. Processing on a melody part is performed in the same manner as in the single operating element performance mode as described above. In this mode, the accompaniment part and the melody part are not synchronized. It should be noted that the operator can arbitrarily determine which channels are to be assigned to the accompaniment part or to the melody part. This mode is selected when the operator freely designates melody sounding timing while listening to the accompaniment part being automatically performed.

(2) Manual Mode

In this mode, the same processing as in the normal automatic performance is performed for all the channels, but the tempo is changed according to operation by the operator.

Specifically, when the operator swings down the operating element 1 in timing of one beat (or two beats), the time interval of peak signals corresponding to the time interval of swinging motions is detected by the CPU 301, and the tempo is sequentially updated according to the time interval of peak signals in the same manner as described above. The updated tempo is stored as the tempo Tempo-R in the current tempo table TB2, and the tempo clock period is determined according to the tempo value Tempo-R. Thus, the tempo of automatic performance is changed according to the time interval of swinging motions of the operating element 1. It should be noted that this processing applies both when a single part is performed and when a plurality of part are performed.

In the above described examples of processing, each time the swinging motion of the operating element 1 is detected (i.e. each time one peak signal is detected), performance is caused to proceed by one note. However, each time the. swinging motion of the operating element. 1 is detected, performance may be caused to proceed by a plurality of notes. In this case, a note which follows the detected peak signal can be performed using an already obtained tempo value Tempo-R. Also in the case where a note which follows the detected peak signal is a fermata (such as a quarter note rest), the tempo value Tempo-R can be used to proceed performance.

b: Multiple Operating Element Performance Mode

In the multiple operating element performance mode, a plurality of operators operate their own operating elements to control the performance of respective parts assigned to them, thereby controlling the performance of a piece of music composed of a plurality of parts. In this mode, it is possible to select the note mode or the manual mode; e.g. the performance of a melody part can be controlled in the note mode, while the performance of an accompaniment mode can be controlled in the manual mode.

To perform in the multiple operating performance mode, the operators select a piece of music and assign parts to respective operating elements by operating e.g. the keyboard 306 of the automatic performance apparatus 100. For example, in the case where two operators (the first operator and the second operator) performs, they assign a melody part to the operating element 1-1 (for the first operator), and assign an accompaniment part to the operating element 1-2 (for the second operator). In the following description, the operating element to which the melody part is assigned is referred to as the master operating element 1-1, and the operating element 1-2 to which the accompaniment part is assigned is referred to as the slave operating element 1-2.

Then, the operators further operate e.g. the keyboard 306 to select the note mode or the manual mode for each of the melody part and the accompaniment part. As a result, a multiple operating element performance mode management table TA1 in which channel numbers, identification information for identifying the respective operating elements, performance parts assigned to the respective operating elements, performance control modes assigned to the respective performance parts (property information), and so forth are described is stored in a predetermined area of the RAM 303 (refer to FIG. 11). In other words, the multiple operating element performance mode management table (operation-related information) TA1 which is stored in the predetermined area of the RAM 303 contains the relationship between operating elements and channels, the master-slave relationship between operating elements (which operating element is to be the master, and which operating element is to be the slave), and so forth.

A description will now be given of processing performed in the case where both the master operating element 1-1 and the slave operating element 1-2 are set to the note mode.

Upon acceptance of selections required for performance control, the CPU 301 of the automatic performance apparatus 100 reads out performance data corresponding to a piece of music selected by the operators from the HDD 304, and transfers the readout performance data to the performance data storage area of the RAM 303. On the other hand, the operators (or one of the operators) perform the above-mentioned forehand operation so as to instruct the automatic performance apparatus 100 to start performance. In response to the forehand operation, a peak signal SP is output from the operating element 1, and supplied to the CPU 301. Upon reception of the first peak signal SP1 from the operating element 1, the CPU 301 determines that the operators have performed the forehand operation, and sets the value of the current tempo Tempo-R in the current tempo table in FIG. 6 as the tempo set value (SetTempo).

Thereafter, when the operators start an operation to proceeds the performance (i.e. swinging-down of the operating element 1), each operating element 1 generates a peak signal SP. Each operating element 1 sends the generated peak signal (operation signal) SP and identification information SID for identifying the operating element 1 as operation information to the receiving device 2. Upon reception of the operation information, the CPU 301 refers to the multiple operating mode performance mode management table (operation-related information) TA1, and reads out e.g. note-on events to perform sounding processing on musical tones of parts corresponding to the identification information SID included in the received operation information, so that the performance proceeds.

Figures 11, 12:
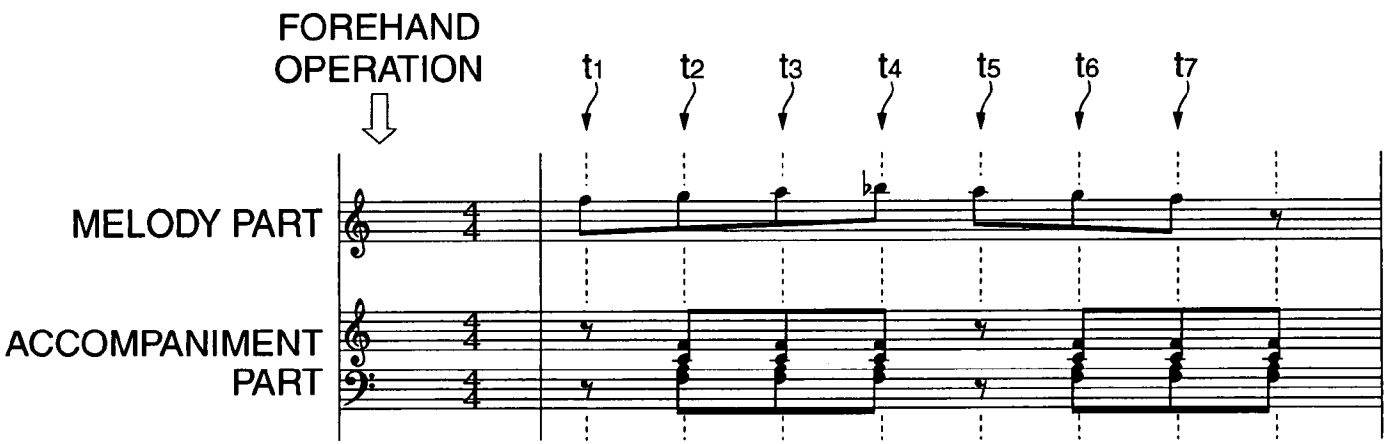
FIG. 11 is a view showing a multiple operating element performance mode management table.
FIG. 12 is a view showing a score useful in explaining a performance process in a multiple operating element performance mode.

A description will now be given of the performance with reference to FIG. 12. For performance of the melody part, each time the CPU 301 detects the operation of the master operating element 1-1 (i.e. each time the CPU 301 receives operation information), the CPU 301 causes a corresponding musical tone to be sounded to proceed the performance on a note-by-note basis (refer to times t1 to t7 in FIG. 12). It should be noted that on this occasion, the tempo is sequentially calculated according to the period of time from the detection of the operation (peak) of the master operating element to the detection of the next operation (peak) of the master operating element, and the note length as described previously.

Figure 13:
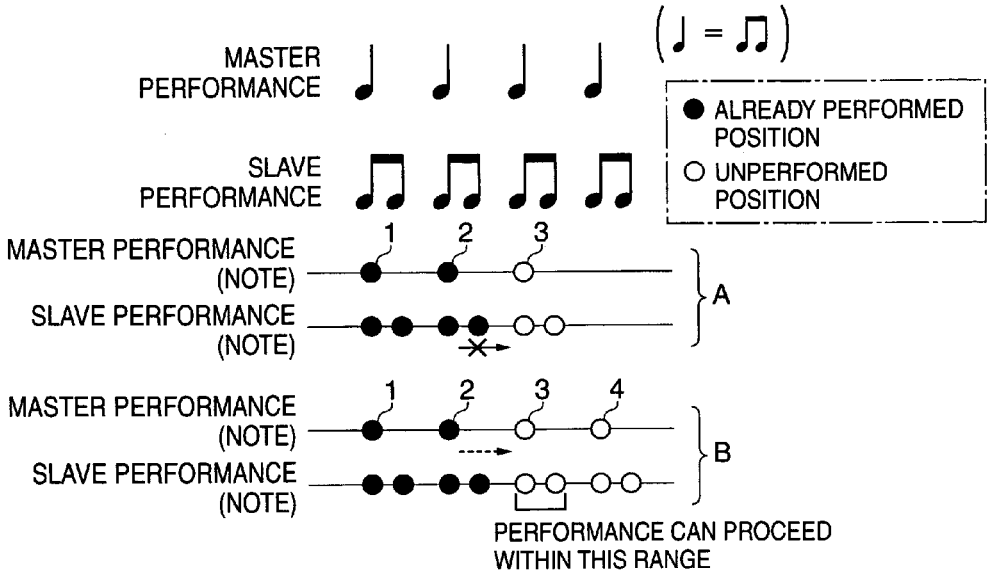
FIG. 13 is a view useful in explaining a performance process carried out in a case 1 in the multiple operating element performance mode.
Figure 14:
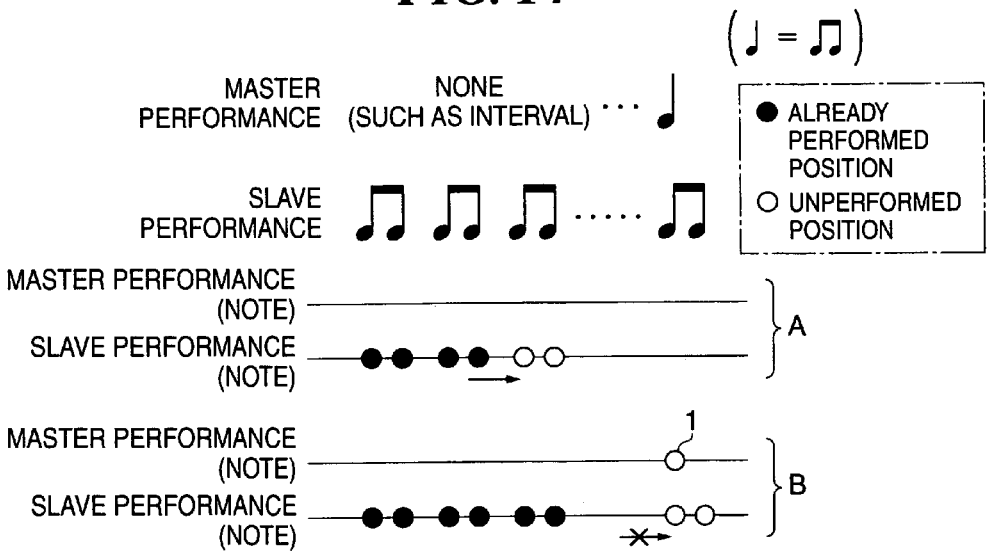
FIG. 14 is a view useful in explaining a performance process carried out in a case 2 in the multiple operating element performance mode.
Figure 15:
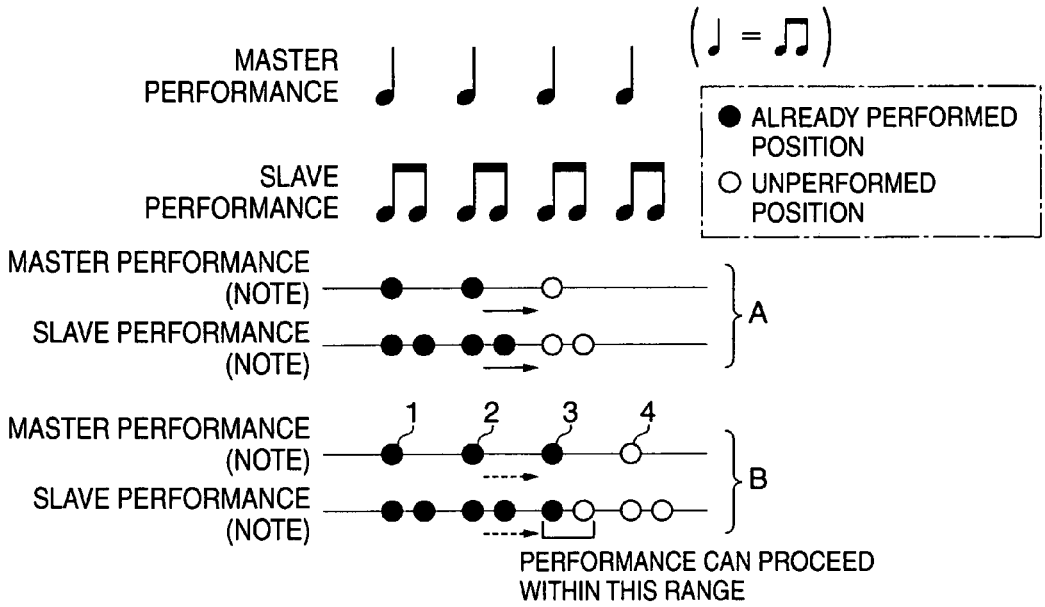
FIG. 15 is a view useful in explaining a performance process carried out in a case 3 in the multiple operating element performance mode.
Figure 16:
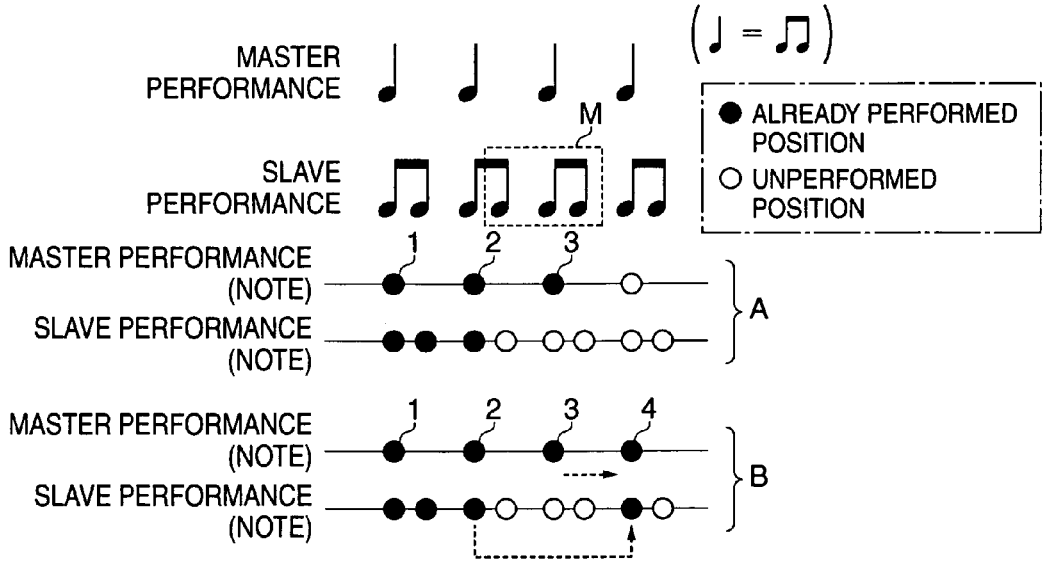
FIG. 16 is a view useful in explaining a performance process carried out in a case 4 in the multiple operating element performance mode.

On the other hand, for performance of the accompaniment part, the CPU 301 carries out one of the following four processes according to timing in which the operation of the slave operating element 1-2 is detected (refer to cases 1 to 4 in FIGS. 13 to 16). It should be noted that the CPU 301 refers to identification information SID included in received operation information to determine whether the operation information is from the master operating element 101 or the slave operating element 102. Here, master performance shown in FIGS. 13 to 16 means the performance of the melody part controlled in performance by the master operating element 101, and slave performance means the performance of the accompaniment part controlled in performance by the slave operating element 1-2. In FIGS. 13 and 16, black circles and white circles indicate the performance positions of the master performance or the slave performance; the black circles indicate positions at which performance has already been carried out (already performed positions), and the white circles indicate positions at which performance has not been carried out (unperformed positions).

(Case 1)

FIG. 13 is a view useful in explaining a performance process in a case 1 in the multiple operating element performance mode.

The CPU 301 constantly checks the next performance position of the master operating element (operating element as the master) 1-1 (the position at which a sounding event is to be processed next) to provide control such that the current performance position (the position at which a current sounding event is being processed) of the slave operating element (operating element as the slave) 1-2 does not go beyond the next performance position of the master operating element 1-1. Namely, the CPU 301 provides control such that the slave performance does not proceed ahead of the master performance. For example, as shown by an example A in FIG. 13, at a time point the CPU 301 receives operation information from the master operating element 1-2, if the operation of the slave operating element 1-2 is detected in the case where the master performance has proceeded to a performance position (current performance position) "2" of the master performance, and the slave performance has proceeded to a position immediately before an unperformed position (next performance position) "3" of the master performance, the CPU 301 inhibits the slave performance from proceeding any longer on the principle that the slave performance should never proceed ahead of the master performance. In this case, as shown by an example B in FIG. 13, the slave performance is caused to proceed when the operation of the slave operating element 1-2 is detected after the master performance has proceeded to the performance position "3". On this occasion, however, the slave performance can be caused to proceed only to a position immediately before an unperformed position "4" of the master performance. In other words, in the above case, the slave performance can be caused to proceed only within such a range as not to go beyond the unperformed position "4" of the master performance.

(Case 2)

FIG. 14 is a view useful in explaining a performance process in a case 2 in the multiple operating element performance mode.

When the operation of the slave operating element 1-2 is detected only in timing corresponding to a part of a piece of music where the performance of the melody part is interrupted and only the accompaniment part is performed, such as during an interlude in a piece of music, as shown by an example A in FIG. 14, the CPU 301 causes the slave performance to proceed in the timing in which the operation of the slave operating element 1-2 is detected. However, the slave performance can be caused to proceed only within the part of the piece of music where only the accompaniment part is performed. In other words, as shown by an example B in FIG. 14, the slave performance can be caused to proceed to a position immediately before an unperformed position "1" where the master performance is resumed. It should be noted that whether the performance position of the slave performance lies in an interlude or not can be determined by e.g. comparing musical tone parameters of a melody part in a piece of music and musical tone parameters of an accompaniment part with each other.

(Case 3)

FIG. 15 is a view useful in explaining a performance process in a case 3 in the multiple operating element performance mode.

In the case where the operation of the slave operating element 1-2 is detected at the same time when the operation of the master operating element 1-1 is detected, or is detected within a predetermined period of time (such as 300 ms) after the operation of the master operating element 1-1 is detected, the CPU 301 causes the slave performance in the timing in which the operation of the slave operating element 1-2 has been detected. For example, as shown by an example A in FIG. 15, if the operation of the slave operating element 1-2 is detected at the same time when the operation of the master operating element 1-1 is detected when the slave performance has proceeded to a position immediately before an unperformed position "3" of the master performance, the CPU 301 causes the master performance to proceed to a performance position "3" and causes the slave performance to proceed to a position corresponding to the performance position "3" of the master performance, as shown by an example B in FIG. 15. It should be noted that in the case where the operation of the slave operating element 1-2 is detected again within the above predetermined period of time, the slave performance can be caused to proceed only to a position immediately before an unperformed position "4" of the master performance.

(Case 4)

FIG. 16 is a view useful in explaining a performance process in a case 4 in the multiple operating element performance mode.

In the case where the operation of the slave operating element 1-2 is detected when the slave performance is delayed behind the master performance by a predetermined amount or more (for example, the slave performance is delayed by one quarter note or longer behind the master performance due to the interruption of the slave performance), the CPU 301 causes the performance position of the slave performance to skip to the performance position of the master performance. For example, as shown by an example A in FIG. 16, if the operation of the slave operating element 1-2 is detected at the same time when the master operating element 1-1 is detected when the performance position of the master performance is "3", and the performance position of the slave performance lies at a position corresponding to a performance position "2" of the master performance, the CPU 301 causes the master performance to proceed to a performance position "4" and causes the slave performance to skip to a position corresponding to the performance position "4" as shown by an example B in FIG. 16. As a result, the skipped sequence of notes (refer to a part indicated by M in FIG. 16) is not performed, but a note corresponding to the performance position after the skip is sounded.

As described above, in the case where both the master operating element 1-1 and the slave operating element 1-2 are set in the note mode, even if the operation of the slave operating element 1-2 precedes the operation of the master operating element 1-1, the slave performance never proceeds ahead of the master performance. However, in the case where the slave performance which proceeds according to the operation of the slave operating element 1-2 is behind the master performance which proceeds according to the operation of the master operating element 1-1, the performance position of the slave performance is caused to skip to the performance position of the master performance so as to synchronize the slave performance and the master performance. As a result, even if the second operator interrupts the operation of the slave operating element 1-2 during performance, the slave performance and the master performance can be synchronized with each other only by the second operator resuming the operation of the slave operating element 1-2 (i.e. without the necessity of performing any complicated operations so as to synchronize the slave performance and the master performance).

In the examples shown in FIGS. 13 to 16, both the master operating element 1-1 and the slave operating element 1-2 are set in the note mode. On the other hand, in an example shown in FIG. 17, the master operating element 1-1 is set in the note mode, and the slave operating element 1-2 is set in the manual mode. However, when the operating element is set in the manual mode, substantially the same process is carried out as in the above described cases 1-3 except for a case 4' described below (corresponding to the above case 4), and therefore description thereof is omitted. ps (Case 4')

Figures 17, 18:
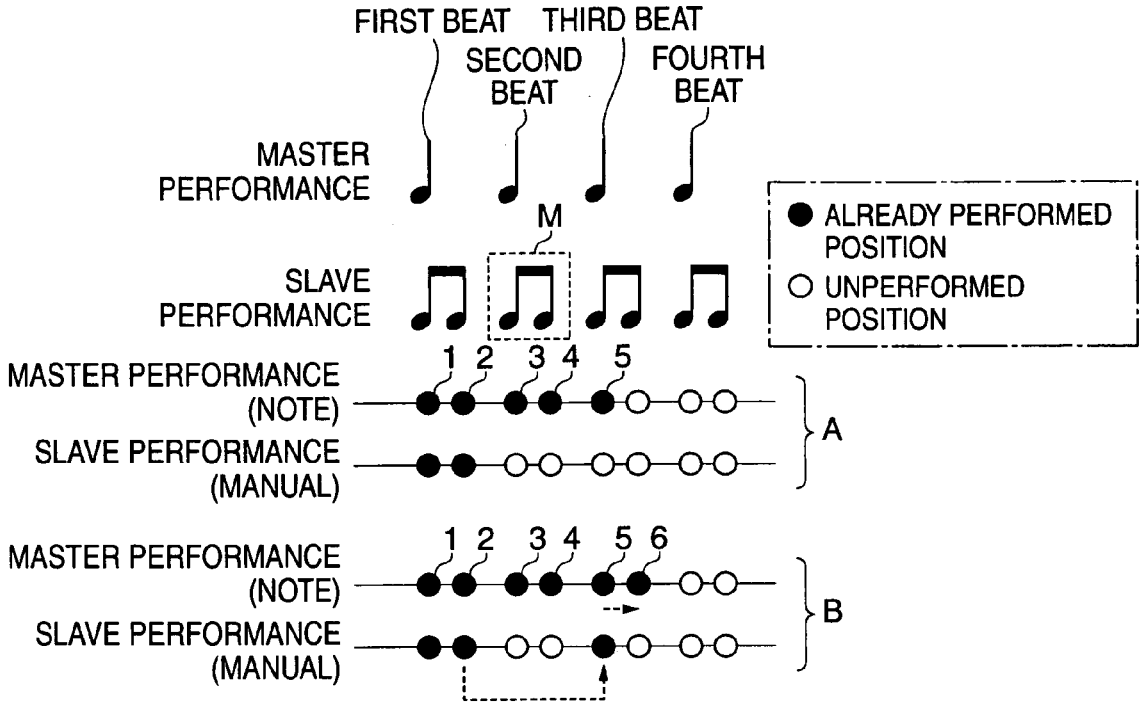
FIG. 17 is a view useful in explaining a performance process carried out in a case 4' in the multiple operating element performance mode.
FIG. 18 is a view showing a volume management table.

FIG. 17 is a view useful in explaining a performance process carried out in the case 4' in the multiple operating element performance mode.

As in the case 4, if detecting the operation of the slave operating element 1-2 when the slave performance is delayed behind the master operating performance by a predetermined amount or more (for example, when the slave performance is delayed behind the master performance by one beat or more due to the interruption of the slave performance), the CPU 301 causes the performance position of the slave performance to skip to a beat position corresponding to the performance position of the master performance. In further detail, for example, if the operation of the slave operating element 1-2 is detected at the same time when the operation of the master operating element 1-1 is detected in the case where the performance position of the master performance is "5", and the performance position of the slave performance lies at a position corresponding to a performance position "2" of the master performance, as shown by an example A in FIG. 17, the CPU 301 causes the master performance to proceed to a performance position "6", and causes the slave performance to skip to a beat position (at the top of the third beat in FIG. 17) corresponding to the performance position of the master performance , as shown by an example B in FIG. 17. Thus, in the case where the slave operating element 1-2 is set in the manual mode, the performance position of the slave performance is not caused to skip to the same position as the performance position of the master performance, but is caused to skip to a beat position corresponding to the performance position of the master performance. As a result, the skipped sequence of notes is not sounded (refer to a part indicated by "M" in FIG. 17), but a note corresponding to the performance position after the skip is sounded. In this way, the slave performance and the master performance can be synchronized even in the case where the slave operating element 1-2 is set in the manual mode.

Although in the above described examples of performance process, the master operating element 1-1 is set in the note mode, and the slave operating element 1-2 is set in the note mode or the manual mode, it goes without saying that the master operating element 1-1 may be set in the manual mode, and the slave operating element 1-2 may be set in the note mode or the manual mode. Further, although in the above described examples of performance process, the operating element 1-1 to which a melody part is assigned is used as the master operating element 1-1, and the operating element 1-2 to which an accompaniment part is used as the slave operating element 1-2, it is possible to determine appropriately whether an operating element to which a melody part or an accompaniment part is assigned is to be used as a master operating element or a slave operating element; for example, an operating element to which an accompaniment part is assigned may be used as a master operating element, and an operating element to which a melody part is may be used as a slave operating element. Further, although in the above described examples of performance process, two operators carry out synchronized performance using two operating elements 1, it goes without saying that three or more operators may carry out synchronized performance using three or more operating elements 1.

Further, although in the above examples of performance process, the slave performance is suspended for a period of time from the stop of the operation of the slave operating element 1-2 to the resumption of the operation of the slave operating element 1-2, the slave performance may be automatically continued in synchronism with the timing of the operation of the slave operating element 1-2 so that the slave performance can continue even when the slave operating element 1-2 is interrupted, and when the operation of the slave operating element 1-2 is resumed, the operation of the slave operating element 1-2 after the resumption is reflected (i.e. in timing in which the slave operating element 1-2 is operated) to carry out the slave performance. It should be noted that whether the operation of the slave operating element 1-2 has been stopped or not can be determined according to whether the next operation has been detected or not within a predetermined period of time (for example, 500 ms) after the detection of the operation of the slave operating element 1-2.

Further, although in the above examples of performance process, the tempo is sequentially calculated according to the period of time from the detection of the operation (peak) of each operating element to the detection of the next operation (peak) and the note length, this is not limitative, but for example, the magnitude of the operation (peak) of each operating element) may be detected and reflected on the volume. FIG. 18 is a view showing an example of a volume management table TA2 stored in the RAM 303.

In the volume management table TA2, values Psp of the peak signal SP and volume values v are registered in association with each other. As shown in FIG. 18, the volume values v are set to become greater substantially in proportion to the values Psp of the peak signal SP. Upon reception of operation information from each operating element 1, the CPU 301 refers to a value of the peak signal SP indicated by the operation information and the volume management table TA2 to determine a volume value v. As a result, when an operator slightly swings down the operating element 1 (for example, $a_0$□Psp□$a_1$), performance tones of the part to be controlled become smaller in volume, and conversely, when the operator widely swings down the operating element 1 (for example, $a_0$□Psp), performance tones of the part become larger in volume. Thus, it is possible to reflect the operation of the operating element 1 on the volume of performance tones. It should be noted that the magnitude of the peak may be reflected on the volume in the single operating element performance mode as well.

It is to be understood that the object of the present invention may also be accomplished by supplying a system or an apparatus with a storage medium (or a recording medium) in which a program code of software, which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and hence the program code and a storage medium on which the program code is stored constitute the present invention.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing the program code read out from the storage medium into a memory provided in an expansion board inserted into a computer or a memory provided in an expansion unit connected to the computer and then causing a CPU or the like provided in the expansion board or the expansion unit to perform a part or all of the actual operations based on instructions of the program code.

Further, the above program has only to realize the functions of the above-mentioned embodiment on a computer, and the form of the program may be an object code, a program executed by an interpreter, or script data supplied to an OS.

Examples of the storage medium for supplying the program code include a floppy (registered trademark) disk, a hard disk, an optical disk, a magnetic-optical disk, a CD-ROM, an MO, a CD-R, a CD-RW, a DVD-ROM, a DVD-RAM, a DVD-RW, a DVD+RW, a magnetic tape, a non-volatile memory card, and a ROM. Alternatively, the program is supplied by downloading from another computer, a database, or the like, not shown, connected to the Internet, a commercial network, a local area network, or the like.

What is claimed is:

1. An automatic performance apparatus that carries out ensemble performance by sequentially reading out a plurality of sounding events representative of sounding contents of musical tones for a plurality of channels from performance data in which the plurality of sounding events are associated with the plurality of channels, and processing the readout sounding events, comprising:

a plurality of operating elements that output operation signals according to operation by at least one operator, and identification information for identifying said plurality of operating elements;

a storage that stores operation-related information indicative of a relationship between respective ones of said plurality of operating elements and respective ones of the plurality of channels, and a master-slave relationship between said plurality of operating elements;

a sounding processing device operable when the operation signals and the identification information are output from the respective ones of said plurality of operating elements, to refer to the operation-related information to determine corresponding ones of the channels to the identification information, and read out a sounding event of a musical tone to be sounded next from the performance data for each of the corresponding ones of the channels and carry out a sounding process on the readout sounding event; and a sounding process control device that controls the sounding process carried out by said sounding processing device such that a position of a sounding event corresponding to at least one of the operating elements as a slave never goes beyond a position of a sounding event corresponding to one of the operating elements as a master, which is to be processed next by said sounding processing device.

2. An automatic performance apparatus according to claim 1, wherein said sounding process control device is operable when an operation signal is output from the operating element as a slave, to determine whether a position of a sounding event corresponding to the operating element as the slave at a time point the operation signal is output has reached a position immediately before a position of a sounding event corresponding to the operating element as the master to be processed next by said sounding processing device, and when a result of the determination is negative, to cause said sounding processing device to proceed the sounding process according to the operation signal within such a range that the position of the sounding event corresponding to the operating element as the slave never goes beyond the position of the sounding event corresponding to the operating element as the slave to be processed next by said sounding processing device.

3. An automatic performance apparatus that carries out ensemble performance by sequentially reading out a plurality of sounding events representative of sounding contents of musical tones for a plurality of channels from performance data in which the plurality of sounding events are associated with the plurality of channels, and processing the readout sounding events, comprising:

a plurality of operating elements that output operation signals according to operation by at least one operator, and identification information for identifying said plurality of operating elements;

a storage that stores operation-related information indicative of a relationship between respective ones of said plurality of operating elements and respective ones of the plurality of channels, and a master-slave relationship between said plurality of operating elements;

a sounding processing device operable when the operation signals and the identification information are output from the respective ones of said plurality of operating elements, to refer to the operation-related information to determine corresponding ones of the channels to the identification information, and read out a sounding event of a musical tone to be sounded next from the performance data for each of the corresponding ones of the channels and carry out a sounding process on the readout sounding event; and a sounding process control device operable when a position of a sounding event corresponding to at least one of the operating elements as a slave is delayed by a predetermined amount or more behind a position of a sounding event corresponding to one of the operating elements as a master to be processed next by said sounding processing device, to cause the position of the sounding event corresponding to the operating element as the slave to skip to the position of the sounding event corresponding to the operating element as the master.

4. A computer-readable medium encoded with an automatic performance program executable by a computer for carrying out ensemble performance by sequentially reading out a plurality of sounding events representative of sounding contents of musical tones for a plurality of channels from performance data in which the plurality of sounding events are associated with the plurality of channels, and processing the readout sounding events, comprising:

a storage module storing operation-related information indicative of a relationship between respective ones of a plurality of operating elements that output operation signals according to operation by at least one operator and identification information for identifying said plurality of operating elements and respective ones of the plurality of channels, and a master-slave relationship between the plurality of operating elements;

a sounding processing module operable when the operation signals and the identification information are output from the respective ones of the plurality of operating elements, to refer to the operation-related information to determine corresponding ones of the channels to the identification information, and read out a sounding event of a musical tone to be sounded next from the performance data for each of the corresponding ones of the channels and carry out a sounding process on the readout sounding event; and a sounding process control module for controlling the sounding process carried out by said sounding processing module such that a position of a sounding event corresponding to at least one of the operating elements as a slave never goes beyond a position of a sounding event corresponding to one of the operating elements as a master to be processed next by said sounding processing module.

5. A computer-readable medium encoded with an automatic performance program executable by a computer for carrying out ensemble performance by sequentially reading out a plurality of sounding events representative of sounding contents of musical tones for a plurality of channels from performance data in which the plurality of sounding events are associated with the plurality of channels, and processing the readout sounding events, comprising:

a storage module storing operation-related information indicative of a relationship between respective ones of a plurality of operating elements that output operation signals according to operation by at least one operator and identification information for identifying said plurality of operating elements and respective ones of the plurality of channels, and a master-slave relationship between the plurality of operating elements;

a sounding processing module operable when the operation signals and the identification information are output from the respective ones of the plurality of operating elements, to refer to the operation-related information to determine corresponding ones of the channels to the identification information, and read out a sounding event of a musical tone to be sounded next from the performance data for each of the corresponding ones of the channels and carry out a sounding process on the readout sounding event; and a sounding process control module for, when a position of a sounding event corresponding to at least one of the operating elements as a slave is delayed by a predetermined amount or more behind a position of a sounding event corresponding to one of the operating elements as a master to be processed next by said sounding processing module, causing the position of the sounding event corresponding to the operating element as the slave to skip to the position of the sounding event corresponding to the operating element as the master.

6. An automatic performance apparatus that carries out automatic performance by sequentially reading out sounding events representative of contents of musical tones from performance data containing the sounding events, comprising:

at least one operating element that outputs an operation signal according to operation by at least one operator;

a sounding processing device operable when the operation signal is output, to read out a sounding event of a musical tone to be sounded next from the performance data, and carry out a sounding process on the readout sounding event;

a time interval calculating device that detects an output time at which the operation signal is output, and calculates a time interval between the detected output time and a previously detected output time;

a tempo updating device that updates a tempo according to the time interval calculated by said time interval calculating device and a length of a note of the sounding event on which the sounding process has been carried out in a time period between the detected output time and the previously detected output time; and a sounding length control device that controls a sounding length of a sounding event to be processed next by said sounding processing device to a length corresponding to the tempo updated by said tempo updating device.

7. An automatic performance apparatus according to claim 6, wherein when there are a plurality of sounding events to be sounded at a same time, said sounding processing device reads out all of the plurality of events from the performance data, and carry out sounding processes on the readout events.

8. An automatic performance apparatus that carries out ensemble performance by sequentially reading out a plurality of sounding events representative of sounding contents of musical tones for a plurality of channels in parallel from performance data in which the plurality of sounding events are associated with the plurality of channels, and processing the readout sounding events, comprising:

at least one operating element that outputs an operation signal according to operation by at least one operator;

a specific channel sounding processing device operable when the operation signal is output, to read out a sounding event of a musical tone to be sounded next from the performance data for a predetermined specific channel, and carry out a sounding process on the readout sounding event;

a time interval calculating device that detects an output time at which the operation signal is output, and calculates a time interval between the detected output time and a previously detected output time;

a tempo updating device that updates a tempo according to the time interval calculated by said time interval calculating device and a length of a note of the sounding event on which the sounding process has been carried out in a time period between the detected output time and the previously detected output time;

a sounding length control device that controls a sounding length of a sounding event to be processed next by said sounding processing device to a length corresponding to the tempo updated by said tempo updating device; and an other channel sounding control device that sequentially reads out at least one sounding event for at least one other channel, which exists in an time interval from the sounding event being processed by said specific channel sounding processing device to a next sounding event, from the performance data at a velocity corresponding to the tempo updated by said tempo updating device, carries out a sounding process on the readout at least one sounding event according to sounding contents represented by the readout at least one sounding event, and controls a sounding length of the at least one sounding event for the at least one other channel to a length corresponding to the updated tempo.

9. An automatic performance apparatus according to claim 8, wherein when there are a plurality of sounding events to be sounded at a same time, said sounding processing device reads out all of the plurality of events from the performance data, and carry out sounding processes on the readout events.

10. A computer-readable medium encoded with an automatic performance program executable by a computer, comprising:

a sounding processing module operable when a sounding instruction signal is output, to read out a sounding event of a musical tone to be sounded next from performance data, and carry out a sounding process on the readout sounding event according to sounding contents represented by the readout sounding event;

a time interval calculating module for detecting a reception time at which the sounding instruction signal is received, and calculates a time interval between the detected reception time and a previously detected reception time;

a tempo updating module for updating a tempo according to the time interval calculated by said time interval calculating module and a length of a note of the sounding event on which the sounding process has been carried out in a time period between the detected reception time and the previously detected reception time; and a sounding length control module for controlling a sounding length of a sounding event to be processed next by said sounding processing module to a length corresponding to the tempo updated by said tempo updating module.

11. A computer-readable medium encoded with an automatic performance program executable by a computer, comprising:

a specific channel sounding processing module operable when a sounding instruction signal is output, to read out a sounding event of a musical tone to be sounded next from performance data, and carry out a sounding process on the readout sounding event according to sounding contents represented by the readout sounding event;

a time interval calculating module for detecting a reception time at which the sounding instruction signal is received, and calculates a time interval between the detected reception time and a previously detected reception time;

a tempo updating module for updating a tempo according to the time interval calculated by said time interval calculating module and a length of a note of the sounding event on which the sounding process has been carried out in a time period between the detected reception time and the previously detected reception time;

a sounding length control module for controlling a sounding length of a sounding event to be processed next by said sounding processing module to a length corresponding to the tempo updated by said tempo updating module; and an other channel sounding control module for sequentially reading out at least one sounding event for at least one other channel, which exists in an time interval from the sounding event being processed by said specific channel sounding processing module to a next sounding event, from the performance data at a velocity corresponding to the tempo updated by said tempo updating module, carrying out a sounding process on the readout at least one sounding event according to sounding contents represented by the readout at least one sounding event, and controlling a sounding length of the at least one sounding event for the at least one other channel to a length corresponding to the updated tempo.

12. A method for carrying out ensemble performance by sequentially reading out a plurality of sounding events representative of sounding contents of musical tones for a plurality of channels from performance data in which the plurality of sounding events are associated with the plurality of channels, and processing the readout sounding events, comprising:

storing operation-related information indicative of a relationship among respective ones of a plurality of operating elements and outputting operation signals according to operation by at least one operator and identification information for identifying said plurality of operating elements and respective ones of the plurality of channels, and a master-slave relationship between the plurality of operating elements;

operating a sound processing module when the operation signals and the identification information are output from the respective ones of the plurality of operating elements: to refer to the operation-related information, to determine corresponding ones of the channels to the identification information, and to read out a sounding event of a musical tone to be sounded next from the performance data for each of the corresponding ones of the channels and carry out a sounding process on the readout sounding event; and controlling the sound processing module such that the position of a sounding event corresponding to at least one of the operating elements as a slave never goes beyond the position of a sounding event corresponding to one of the operating elements as a master to be processed next by said sounding processing module.

13. A method for carrying out ensemble performance by sequentially reading out a plurality of sounding events representative of sounding contents of musical tones for a plurality of channels from performance data in which the plurality of sounding events are associated with the plurality of channels, and processing the readout sounding events, comprising:

storing operation-related information indicative of a relationship among respective ones of a plurality of operating elements that output operation signals according to operation by at least one operator and identification information for identifying said plurality of operating elements and respective ones of the plurality of channels, and a master-slave relationship between the plurality of operating elements;

operating a sounding processing module when the operation signals and the identification information are output from the respective ones of the plurality of operating elements: to refer to the operation-related information, to determine corresponding ones of the channels to the identification information, and to read out a sounding event of a musical tone to be sounded next from the performance data for each of the corresponding ones of the channels and carry out a sounding process on the readout sounding event; and controlling the sounding process module such that when the position of a sounding event corresponding to at least one of the operating elements as a slave is delayed by a predetermined amount or more behind the position of a sounding event corresponding to one of the operating elements as a master to be processed next by said sounding processing module, the position of the sounding event corresponding to the operating element as the slave is caused to skip to the position of the sounding event corresponding to the operating element as the master.

14. A sound processing method, comprising:

controlling a sounding processing module operable when a sounding instruction signal is output, to read out a sounding event of a musical tone to be sounded next from performance data, and to carry out a sounding process on the readout sounding event according to sounding contents represented by the readout sounding event;

detecting a reception time at which the sounding instruction signal is received, and calculating a time interval between the detected reception time and a previously detected reception time;

updating a tempo according to the calculated time interval and updating a length of a note of the sounding event on which the sounding process has been carried out in a time period between the detected reception time and the previously detected reception time; and controlling a sounding length of a sounding event to be processed next by said sounding processing module to a length corresponding to the tempo updated by said tempo updating module.

15. A sound processing method, comprising:

controlling a specific channel sounding processing module operable when a sounding instruction signal is output, to read out a sounding event of a musical tone to be sounded next from performance data, and carry out a sounding process on the readout sounding event according to sounding contents represented by the readout sounding event;

detecting a reception time at which the sounding instruction signal is received, and calculating a time interval between the detected reception time and a previously detected reception time;

updating a tempo according to the calculated time interval and updating a length of a note of the sounding event on which the sounding process has been carried out in a time period between the detected reception time and the previously detected reception time;

controlling a sounding length of a sounding event to be processed next by said sounding processing module to a length corresponding to the tempo updated by said tempo updating module; and causing an other channel sounding control module:

to sequentially read out at least one sounding event for at least one other channel, which exists in an time interval from the sounding event being processed by said specific channel sounding processing module to a next sounding event, from the performance data at a velocity corresponding to the updated tempo, to carry out a sounding process on the readout at least one sounding event according to sounding contents represented by the readout at least one sounding event, and to control a sounding length of the at least one sounding event for the at least one other channel to a length corresponding to the updated tempo.

* * * * *